United States Patent [19]

Aoki et al.

[11] Patent Number: 4,760,709

[45] Date of Patent: Aug. 2, 1988

[54] FIVE-WAY VALVE HAVING SIMULTANEOUS DEFROSTING AND HEATING FUNCTIONS

[75] Inventors: Tadashi Aoki; Tadatoshi Ashikaga; Hiroshi Kuno; Masakazu Isobe, all of Tokyo; Hideaki Ohhira, Sayama, all of Japan

[73] Assignee: Kabushiki Kaisha Saginomiya Seisakusho, Tokyo, Japan

[21] Appl. No.: 95,391

[22] Filed: Sep. 10, 1987

[30] Foreign Application Priority Data

| | | | |
|---|---|---|---|
| Sep. 11, 1986 | [JP] | Japan | 61-212756 |
| May 11, 1987 | [JP] | Japan | 62-112504 |
| May 15, 1987 | [JP] | Japan | 62-117095 |
| May 15, 1987 | [JP] | Japan | 62-117096 |

[51] Int. Cl.[4] ..... F25B 13/00

[52] U.S. Cl. ..... 62/324.6; 137/625.43

[58] Field of Search ..... 137/625.33, 625.43; 62/324.1, 324.6

[56] References Cited

U.S. PATENT DOCUMENTS

| | | | |
|---|---|---|---|
| 2,974,682 | 3/1961 | Trask | 137/625.33 |
| 2,976,701 | 3/1961 | Greenawalt | 62/324 |
| 3,867,960 | 2/1975 | Hosoda et al. | 62/324.6 X |
| 3,952,537 | 4/1976 | Aoki et al. | 62/324.6 |
| 4,112,974 | 9/1978 | Davis et al. | 62/324.6 X |
| 4,306,422 | 12/1981 | Korycki | 137/625.43 X |
| 4,644,760 | 2/1987 | Aoki et al. | 62/324.6 |

*Primary Examiner*—Lloyd L. King

*Attorney, Agent, or Firm*—Lowe, Price, LeBlanc, Becker & Shur

[57] ABSTRACT

A five-way valve includes a cylindrical valve body. A piston member is employed in one end of the cylindrical valve body to define a high pressure chamber and a first pressure chamber. A defrosting valve is employed in the other end of the cylindrical valve body to define a second pressure chamber. A slider valve member coupled to the piston member is slidably employed within said high pressure chamber into which the high temperature and high pressure refrigerant from the compressor is induced. An electromagnetic valve is connected between both the first and second pressure converting chambers, and the inlet of the compressor. When the electromagnetic valve is energized to communicate the second pressure converting chamber with the inlet of the compressor, resulting in the generation of a pressure difference in the defrosting valve member, the defrosting valve member is actuated to pass the high temperature and high pressure refrigerant in the high pressure chamber to the inlet of the outdoor heat exchanger for the defrosting purpose, while the indoor heat exchanger is operated to heat ambient atmosphere.

27 Claims, 17 Drawing Sheets

FIVE-WAY VALVE HAVING SIMULTANEOUS DEFROSTING AND HEATING FUNCTIONS

BACKGROUND OF THE INVENTION

The present invention generally relates to a valve for a refrigerating system of the heat pump type, and more particularly to a novel five-way valve capable of performing simultaneous heating/cooling operations for heat pump type refrigerating systems.

A refrigerating system employing a reversible refrigerating cycle (i.e., a heat pump cycle) normally includes indoor and outdoor heat exchangers connected to a compressor and an expansion valve via a valve for switching heating/cooling operations such as, for instance, a four-way valve. In such a refrigerant flow reversing system, to heat indoor ambient atmosphere during cold weather, the indoor heat exchanger acts as a condenser while the outdoor heat exchanger acts as an evaporator. A typical one of such conventional refrigerating systems is disclosed, for example, in U.S. Pat. No. 2,974,682 to TRASK (1961) and U.S. Pat. No. 2,976,701 to GREENAWALT (1961).

However, the conventional reversible refrigerating system has the following drawbacks in regard to its defrosting operation during cold weather while the indoor heat exchanger is operated as a heater. In particular, every time a defrosting operation is to be performed, the heating/cooling switching valve must be operated to control the system in such a manner that the indoor heat exchanger must stop its heating operation and start its cooling operation. Such cooling operation continues until the defrosting operation is completed. After completion of the defrosting operation, the switching valve is changed over again in order to cause the indoor heat exchanger to perform the normal heating operation. Since the indoor heat exchanger is controlled so as to temporarily operate as a cooling machine for each defrosting operation in this manner, there is a drawback that the efficiency of the refrigerating system during the cold weather is deteriorated. Another problem is that, during the heating operation, a user may feel uncomfortable, though temporarily, due to a cool air flow from the indoor heat exchanger.

It is therefore a primary object of the present invention to provide a novel five-way valve for switching cooling/heating operations which can defrost an outdoor heat exchanger of a reversible refrigerating system without interrupting a heating operation of the indoor heat exchanger.

It is another object of the present invention to provide a five-way valve for switching cooling/heating operations which can be employed in a refrigerant flow reversing system and can assure a reliable switching operation with a simplified structure.

SUMMARY OF THE INVENTION

The above-described and other objects of the invention are realized by employing a five-way valve (102) operable in a refrigerant flow reversing system comprising:

a hollow valve body (1);

a piston (12) slidably provided within the hollow valve body (1) to divide the valve body into a high pressure chamber ($R_1$) and a first pressure converting chamber ($R_2$), and having a pressure equalizer (12A) for equalizing pressures between the high pressure chamber ($R_1$) and the first pressure converting chamber ($R_2$), the high pressure chamber ($R_1$) including a first valve port (5) communicating with an outlet of a compressor (120) to receive a high temperature and high pressure refrigerant, a second valve port (6) communicating with an inlet of the compressor (120), a third valve port (7) communicating with an outdoor heat exchanger (180), and a fourth valve port (8) communicating with an indoor heat exchanger (140);

a slider valve (21) slidably provided within the high pressure chamber ($R_1$) and mechanically connected to the piston (12), for selectively communicating the second valve port (6) for the inlet of the compressor (120) with one of the third and fourth valve ports (7, 8), whereby the indoor and outdoor heat exchangers (140, 180) are selectively changed for selectively heating and cooling ambient atmosphere thereof;

a defrosting valve (24) provided within the hollow valve body (1) to define a second pressure converting chamber ($R_3$), the second pressure converting chamber ($R_3$) including a fifth valve port (27) communicating with the outdoor heat exchanger (180) to pass the high temperature and high pressure refrigerant induced in the high pressure chamber ($R_1$) to the outdoor heat exchanger (180), the defrosting valve (24) having a passage (23C) to receive a high pressure of the refrigerant induced in the high pressure chamber ($R_1$);

a first connecting member (28) for connecting the first pressure converting chamber ($R_2$) to the second pressure converting chamber ($R_3$) so as to equalize pressures in the first and second pressure converting chambers ($R_2$, $R_3$) with each other;

a second connecting member (14) for connecting the first pressure converting chamber ($R_2$) to the second valve port (6) for the inlet of the compressor (120); and, an electromagnetic valve (16) for selectively opening and closing a passage of the second connecting member (14) so as to communicate the first and second pressure converting chambers ($R_2$, $R_3$) with the second valve port (6) in cooperation with the second connecting member (14), whereby when the electromagnetic valve opens the passage of the second connecting member (14) to produce a lower pressure than the pressure in the high pressure chamber at least in the second pressure converting chamber ($R_3$), the defrosting valve (24) is actuated to pass the high temperature and high pressure refrigerant in the high pressure chamber ($R_1$) to the outdoor heat exchanger (180) via the fifth valve port (27) while the indoor heat exchanger receives the high temperature and high pressur refrigerant from the high pressure chamber ($R_1$, ) to heat the ambient atmosphere thereof.

Further, these objects are achieved by employing a five-way valve (104) operable in a refrigerant flow reversing system comprising:

a hollow valve body (1);

a piston (12) slidably provided within the hollow valve body to divide the valve body a high pressure chamber ($R_1$) and a first pressure converting chamber ($R_2$), and having a first pressure equalizer (12A) for equalizing pressures between the high pressure chamber ($R_1$) and the first pressure converting chamber, the high pressure chamber (R) including a first valve port (5) communicating with an outlet of a compressor (120) to receive a high temperature and high pressure refrigerant, a second valve port (6) communicating with an inlet of the compressor, a third valve port (7) communicating with an outdoor heat exchanger (180), a fourth valve port (8) communicating with an indoor heat exchanger (140), and a fifth valve port (27) communicating with the outdoor heat exchanger;

a slider valve (21) slidably provided within the high pressure chamber ($R_1$) and mechanically connected to the piston (12), for selectively communicating the second valve port (6) for the inlet of the compressor (120) with one of the third and fourth valve ports (7, 8), whereby the indoor and outdoor heat exchangers (140, 180) are selectively changed for selectively heating and cooling ambient atmosphere thereof;

a defrosting valve provided within the hollow valve body (1) to define a second pressure converting chamber ($R_3$), and including a piston member (44) having a second pressure equalizer (44A) for communicating the second pressure converting chamber with the high pressure chamber, and a defrosting valve body (48) slidably connected to the piston member for opening and closing a passage of the fifth valve port;

a separator (36) provided within the first pressure converting chamber ($R_2$) to define a third pressure converting chamber ($R_4$), the third pressure converting chamber including an auxiliary valve member (37) actuatable in response to the sliding operation of the piston (12), and a valve hole (36A) for communicating the first pressure converting chamber ($R_2$) with the third pressure converting chamber ($R_4$) in response to operation of the auxiliary valve;

a first connecting member (31) for connecting the second pressure converting chamber ($R_3$) to the third pressure converting chamber ($R_4$) so as to equalize pressures in the second and third pressure converting chambers with each other;

a second connecting member (14) for connecting the first pressure converting chamber ($R_2$) to the second valve port (6) for the inlet of the compressor (120); and, an electromagnetic valve (35) interposed in the second connecting member (14), for selectively opening and closing a passage of the second connecting member (14) so as to communicate the first, second and third pressure converting chambers ($R_2$, $R_3$, $R_4$) with the second valve port (6) in cooperation with the auxiliary valve member (37) and the piston (12), whereby when the electromagnetic valve opens the passage of the second connecting member (14) to produce a lower pressure than the pressure in the high pressure chamber ($R_1$) at least in the second pressure converting chamber ($R_3$), the defrosting valve body (48) is slid by the piston member (44) to pass the high temperature and high pressure refrigerant in the high pressure chamber ($R_1$) to the outdoor heat exchanger (180) via the fifth valve port (27) while the indoor heat exchanger receives the high temperature and high pressure refrigerant from the high pressure chamber to heat the ambient atmosphere thereof.

According to the present invention, there is also provided a five-way valve (106) operable in a non-azeotropic refrigerant flow reversing system comprising:

a hollow valve body (1);

a piston (52) slidably provided within the hollow body (1) to divide the valve body into a high pressure chamber ($R_1$) and a pressure converting chamber ($R_2$), having a bleed hole (52A) and a bleed valve (52B) for opening and closing the bleed hole (52A), the bleed valve (52B) having a pressure equalizer (52E) for communicating the high pressure chamber ($R_1$) with the pressure converting chamber ($R_2$), and the high pressure chamber ($R_1$) including a first valve port (5) communicating with an outlet of a compressor (120) to receive a high temperature and high pressure non-azeotropic refrigerant, a second valve port (6) communicating with an inlet of the compressor (120), a third valve port (7) communicating with an outdoor heat exchanger (180), and a fourth valve port (8) communicating with an indoor heat exchanger (140);

a slider valve (21) slidably provided within the high pressure chamber ($R_1$) and mechanically connected to the piston (12), for selectively communicating the second valve port (6) for the inlet of the compressor (120) with one of the third and fourth valve ports (7, 8), whereby the indoor and outdoor heat exchangers (140, 180) are selectively changed for selectively heating and cooling ambient atmosphere thereof;

a cooling member (64) interposed between the second valve port (6) and the inlet of the compressor (120);

a reservoir member (62) heat-coupled with the cooling member (64) for storing the non-azeotropic refrigerant;

an expansion valve (260) connected between the indoor heat exchanger (140) and the outdoor heat exchanger (180), and also to the reservoir member for passing the non-azeotropic refrigerant therethrough;

a pressure passage member (55) connected to the pressure converting chamber ($R_2$);

a connecting member (14) for connecting the pressure converting chamber ($R_2$) to the second valve port (6) for the inlet of the compressor (120) via the pressure passage member (55);

an electromagnetic valve (35) for selectively opening and closing a passage of the connecting member (14) so as to communicate the pressure converting chamber ($R_2$) with the valve port (6) in cooperation with the second connecting member (14); and a defrosting controller (65) for electronically controlling the electromagnetic valve (35) and the expansion valve (260), whereby when the electromagnetic valve opens the passage of the connecting member (14) to pass the non-azeotropic refrigerant from the high pressure chamber ($R_1$) to the cooling member (64) via the connecting member (14), the non-azeotropic refrigerant heated in the reservoir member (62) by the heat transfer of the cooling member is forcibly flown into the non-azeotropic refrigerant supplied from the indoor heat exchanger (140) via the expansion valve (260) while fully opening the expansion valve under the control of the defrosting controller (65).

Moreover, according to the present invention, there is provided a five-way valve (108) operable in a refrigerant flow reversing system comprising:

a hollow valve body (1);

a piston (82) slidably provided within the hollow valve body (1) to divide the valve body into a high pressure chamber ($R_1$) and a first pressure converting chamber ($R_2$), and having a pressure equalizer (82A) for equalizing pressures between the high pressure chamber ($R_1$) and the first pressure converting chamber ($R_2$), the high pressure chamber ($R_1$) including a first valve port (5) communicating with an outlet of a compressor (120) to receive a high temperature and high pressure refrigerant, a second valve port (6) communicating with an inlet of the compressor (120), a third valve port (7) communicating with an outdoor heat exchanger (180), and a fourth valve port (8) cimmunicating with an indoor heat exchanger (140);

a slider valve (21) slidably provided within the high pressure chamber ($R_1$) and mechanically connected to the piston (82), for selectively communicating the second valve port (6) for the inlet of the compressor (120) with one of the third and fourth valve ports (7, 8), whereby the indoor and outdoor heat exchangers (140, 180) are selectively changed for selectively heating and cooling ambient atmosphere thereof;

a defrosting valve (80) including a defrosting valve member (87), a pressure passage (80A, $80B_1$), and a fifth valve port (89), and connected to the high pressure chamber ($R_1$) via the pressure passage, the defrosting valve member (87) defining a second pressure converting chamber ($R_3$) within the defrosting valve (80), the second pressure converting chamber ($R_3$) communicating with the high pressure chamber ($R_1$) via the pressure passage to receive the high temperature and high pressure refrigerant from the high pressure chamber, and the fifth valve port (89) being selectively connected to the high pressure chamber ($R_1$) via the pressure passage in response to actuation of the defrosting valve member (87);

a first connecting member (86) for connecting the first pressure converting chamber ($R_2$) to the second pressure converting chamber ($R_3$) so as to equalize pressures in the first and second pressure converting chambers ($R_2$, $R_3$) with each other;

a second connecting member (14) for connecting the first and second pressure converting chambers ($R_2$, $R_3$) to the second valve port (6) for the inlet of the compressor (120); and, an electromagnetic valve (16) interposed in the second connecting member (14) for selectively opening and closing a passage of the second connecting member (14) so as to communicate the first and second pressure converting chambers ($R_2$, $R_3$) with the second valve port (6) in cooperation with the second connecting member (14), whereby when the electromagnetic valve opens the passage of the second connecting member (14) to produce a lower pressure than the pressure in said high pressure chamber at least in the second pressure converting chamber ($R_3$), the defrosting valve member (87) is actuated to pass the high temperature and high pressure refrigerant in the high pressure chamber ($R_1$) to the outdoor heat exchanger (180) via the pressure passage and fifth valve port (89) while the indoor heat exchanger receives the high temperature and high pressure refrigerant from the high pressure chamber ($R_1$) to heat the ambient atmosphere thereof.

Finally, according to the present invention, there is employed a five-way valve (109) operable in a refrigerant flow reversing system comprising:

a hollow valve body (1) for defining a high pressure chamber therein, the high pressure chamber including a first valve port (5) communicating with an outlet of a compressor (120) to receive a high temperature and high pressure refrigerant, a second valve port (6) communicating with an inlet of the compressor, a third valve port (7) communicating with an outdoor heat exchanger (180), and a fourth valve body (8) communicating with an indoor heat exchanger (140);

an electronic reciprocating device (72) connected to one end of the hollow valve body (1), and having a reciprocating member (76) capable of being reciprocated between at least three rest positions;

a slider valve (21) slidably provided within the high pressure chamber, for selectively communicating the second valve port (6) for the inlet of the compressor (120) with one of the third and fourth valve ports (7, 8), whereby the indoor and outdoor heat exchangers (140, 180) are selectively changed to selectively heat and cool ambient atmosphere thereof;

a defrosting valve (90) provided at the other end of the hollow valve body (1), and having a defrosting valve member (92, 94), a pressure passage for sliding the defrosting valve member therethrough, and a fifth valve port (27) communicating with the outdoor heat exchanger (180), the pressure passage communicating with the high pressure chamber and the fifth valve port (27) by means of the defrosting valve member to receive the high temperature and high pressure refrigerant from the high pressure chamber; and a sliding member (70) one end of which is connected to the reciprocating member (76) and the other end of which selectively abuts against the defrosting valve member in response to the reciprocating operation of said reciprocating member (76), and having a concave (70A) loosely engaged with the sliding valve (21) with having a predetermined clearance (C) between one edge portion of the sliding valve (21) and the corresponding edge of the concave (70A), whereby when said reciprocating device (72) slides the sliding valve (21) to communicate the inlet of the compressor (120) with the outdoor heat exchanger (180) and to actuate the defrosting valve (90), the high temperature and high pressure refrigerant in the high pressure chamber is supplied by the defrosting valve (90) to the outdoor heat exchanger via the fifth valve port (27) while the indoor heat exchanger receives the high temperature and high pressure refrigerant from the high pressure chamber to heat the ambient atmosphere thereof.

BRIEF DESCRIPTION OF THE DRAWINGS

For a better understanding of these and other objects of the present invention, reference is made to the following description of the invention to be read in conjunction with the following drawings, in which.

DETAILED DESCRIPTION OF THE PREFERRED EMBODIMENTS

BASIC IDEA

Before proceeding with various types of the preferred embodiments according to the invention, the basic idea of the present invention will now be summarized.

Figure 1:
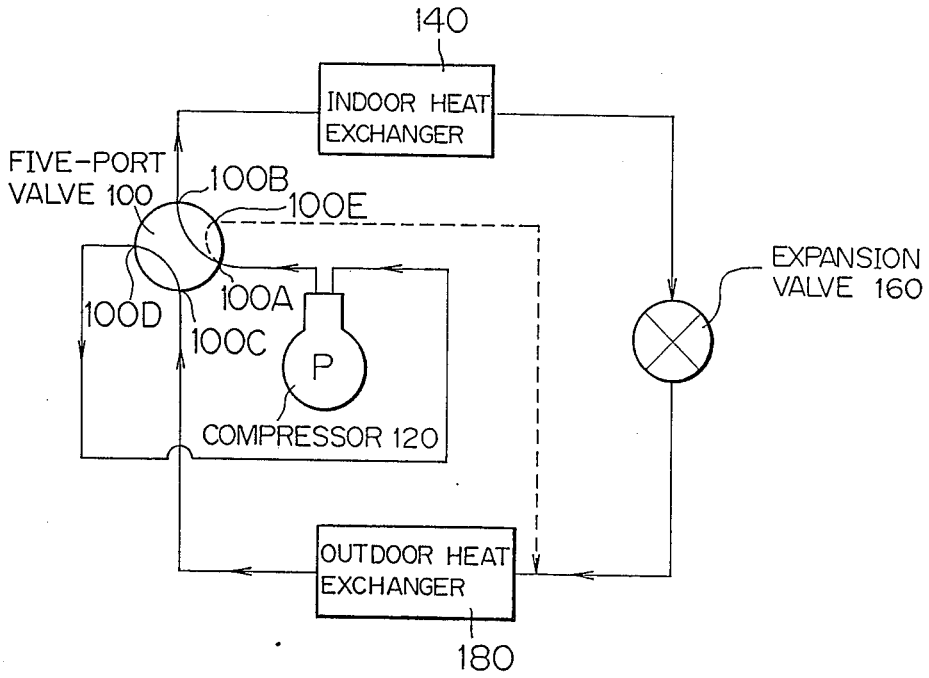
FIG. 1 is a schematic block diagram illustrating a reversible refrigerating system where a five-way valve 100 according to the invention is utilized.

FIG. 1 illustrates a schematic diagram of a reversible refrigerating system employing a five-way valve for switching heating/cooling operations.

The reversible refrigerating system or so-called "heat pump" type refrigerating system shown in FIG. 1 includes a five-way valve 100 according to the present invention. The five-way valve 100 has 5 valve ports 100A to 100E formed therein, and the first valve port 100A is connected to the outlet port of a compressor 120 and the second valve port 100B is connected to the inlet port of an indoor heat exchanger 140. The outlet port of the indoor heat exchanger 140 is connected via an expansion valve 160 to the inlet port of an outdoor heat exchanger 180. The outlet port of the outdoor heat exchanger 180 is connected to the third valve port 100C of the five-way valve 100 which is in turn connected via the fourth valve port 100D to the inlet port of the compressor 120. Further, the fifth valve port 100E of the five-way valve 100 is connected to a passage between the outlet port side of the expansion valve 160 and the inlet port side of the outdoor heat exchanger 180 so that high temperature, high pressure gas (refrigerant) discharged from the compressor 120 may be supplied to the outdoor heat exchanger 180 during the defrosting operation of the refrigerating system. The connection of the five-way valve 100 shown in FIG. 1 is prepared for running of the indoor heat exchanger 140 for heating ambient atmosphere during cold weather. Thus, if the refrigerating system continues its operation for a predetermined period of time in this condition, frost or ice may appear on a heat exchanging section of the outdoor heat exchanger 180 due to cool air outdoors, resulting in deterioration of a function of the outdoor heat exchanger 180 as an evaporator because such frost or ice will disturb an operation of the outdoor heat exchanger 180 to radiate evaporation heat therefrom by a thermal convectional action.

Under such a condition as described above, according to the present invention, while the indoor heat exchanger 140 continues its heating operation in the connection of the five-way valve 100 shown in FIG. 1, the cooling medium or refrigerant in the outdoor heat exchanger 180, that is, the high temperature, high pressure gas supplied into the outdoor heat exchanger 180 from the compressor 120 via the fifth valve port 100E of the five-way valve 100, heats the outdoor heat exchanger 180. As a result of such heating operation, frost, if any, sticking to the evaporator of the outdoor heat exchanger 180 will be fused and thus removed.

By such a sequence of operations as described above, the heat pump type refrigerating system can remove frost sticking to the evaporator of the outdoor heat exchanger 180 without interrupting the heating operation of the indoor heat exchanger 140.

Detailed description of operation of the five-way valve according to the present invention will now be made hereinbelow.

CONSTRUCTION OF FIRST 5-WAY VALVE

Figure 2A:
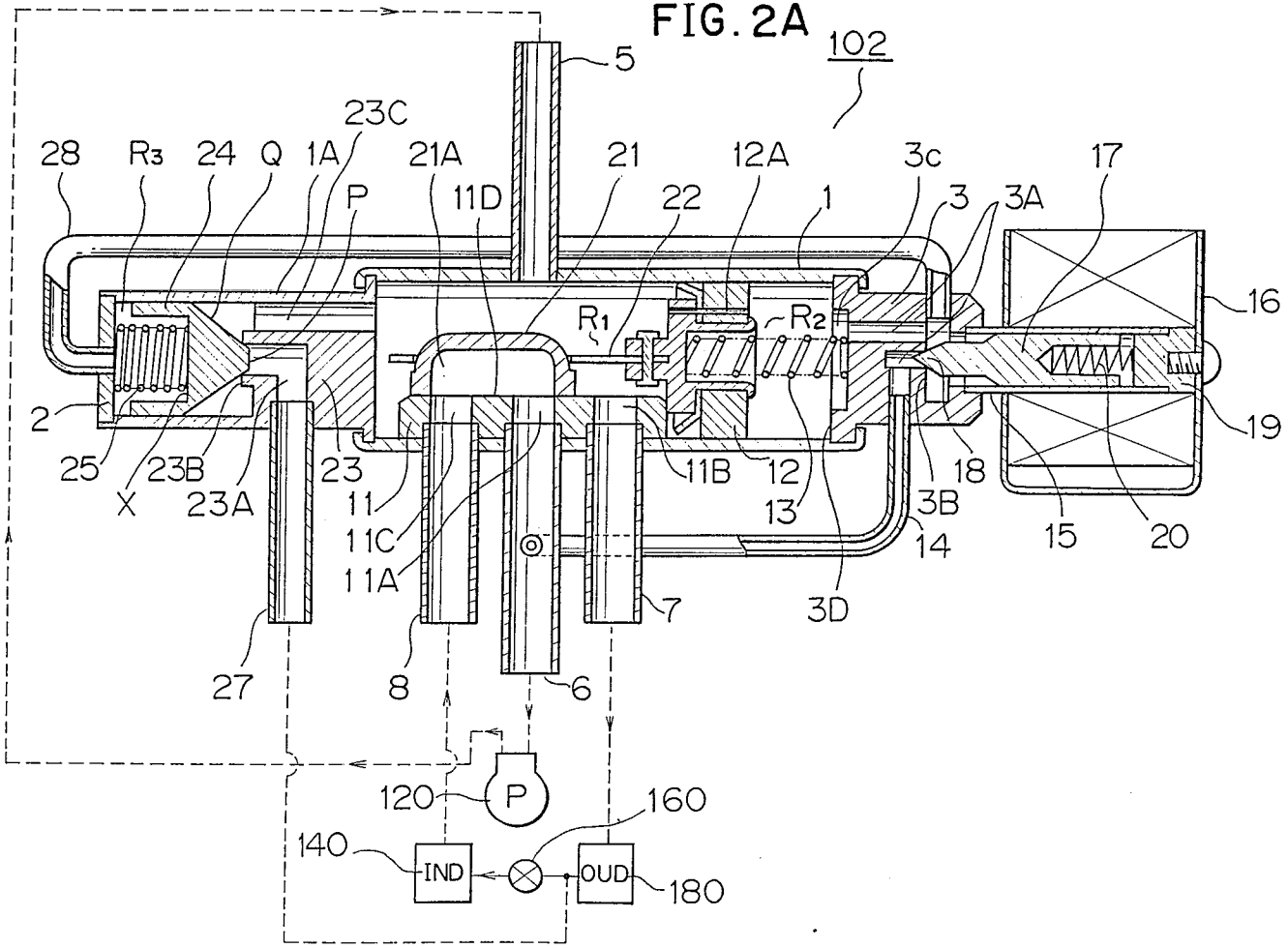
FIGS. 2A to 2E schematically show a five-way valve 102 according to a first preferred embodiment, where the cooling, heating and defrosting modes of the valve are illustrated.

Referring now to FIG. 2A, a five-way valve 102 for switching heating/cooling operations according to a first preferred embodiment of the present invention will be described.

It should be noted that the same reference numerals shown in FIG. 1 will be used for indicating the same or similar elements illustrated in the following figures.

The five-way valve 102 includes a cylindrical valve body 1. A smaller diameter extension cylinder 1A having a lid 2 at an end thereof is located at one end of the cylindrical valve body 1, and another lid 3 is located at the other end of the cylindrical valve body 1. A first valve port 5 for the compressor 120 is connected to a side of a circumferential wall of the cylindrical valve body 1, and third and fourth valve ports 7, 8 are connected to the other side of the circumferential wall of the cylindrical valve body 1 at opposite positions in the axial direction of the cylindrical valve body 1 with respect to a second valve port 6 of the compressor 120 which is similarly connected to the other side of the circumferential wall of the cylindrical valve body 1. The third and fourth ports 7, 8 are connected respectively to the outdoor heat exchanger 180 and the indoor heat exchanger 140 which are each reversibly used as a condenser or an evaporator. The inner ends of the second valve port 6 and the third and fourth valve ports 7, 8 are connected to three through holes 11A, 11B and 11C, respectively, of a switching valve seat 11 fixedly mounted in the cylindrical valve body 1. A continuous smooth face 11D is formed on an inner surface of the valve seat 11.

A piston 12 is mounted to be slid between the valve seat 11 and the lid 3 and along the longitudinal axis of the cylindrical valve body 1. The piston 12 thus partitions the inside space of the cylindrical valve body 1 to define a high pressure chamber $R_1$ and a first pressure converting chamber $R_2$. A compression spring 13 is interposed between the piston 12 and the lid 3 to normally urge the piston 12 toward the high pressure chamber $R_1$ (in a leftward direction as viewed in FIG. 2A). The piston 12 has a pressure-equalizing hole 12A formed therein for normally communicating the high pressure chamber $R_1$ with the first pressure converting chamber $R_2$. Meanwhile, the lid 3 has formed therein a pressure venting hole 3A having a greater diameter than that of the pressure-equalizing hole 12A of the piston 12. A conduit 14 is connected to the pressure venting hole 3A of the lid 3 and to the second valve port 6 of the compressor 120.

An electromagnetic valve 16 is attached to the lid 3 by way of a plunger pipe 15 such that the pressure venting hole 3A of the lid 3 can be opened and closed as a needle valve body 18 provided at one end of a plunger 17 of the electromagnetic valve 16 is moved out of or into contact with a valve seat 3B provided intermediate the pressure venting hole 3A. A compression spring 20 is interposed between the plunger 17 and an iron core 19 of the electromagnetic valve 16 to urge the needle valve body 18 in a direction to contact with the valve seat 3B of the lid 3 (in a leftward direction as viewed in FIG. 2A).

A slider valve 21 having a connecting concave 21A formed therein is located on the valve seat 11 and connected for integral movement with the piston 12 by means of a connecting rod 22. As the slider valve 21 is slid, it will communicate, via the connecting concave 21A therein, the through hole 11A to the second valve port 6 for the compressor 120 alternatively with one of the opposite through holes 11B, 11C to the third and fourth valve ports 7, 8 connected to the outdoor and indoor heat exchangers 180, 140, respectively.

A defrosting valve member 23 having a through hole 23A is positioned near a central portion of the high pressure chamber $R_1$ within the smaller diameter extension cylinder 1A. A valve seat 23B is formed at one end of the through hole 23A of the defrosting valve member 23 opposite to the lid 2. A defrosting valve 24 in the form of a piston is located between the lid 2 and the defrosting valve member 23 for movement into and out of contact with the valve seat 23B of the defrosting valve member 23 to close or open the through hole 23A of the defrosting valve member 23. Thus, a second pressure converting chamber $R_3$ is defined by and between the lid 2 and the defrosting valve 24. The defrosting valve 24 is urged in a direction to close the through hole 23A of the defrosting valve member 23 (rightward direction as viewed in FIG. 2A) by means of a compression spring 25 interposed between the defrosting valve 24 and the lid 2. Connected to the through hole 23A of the defrosting valve member 23 is fifth valve port 27 which is connected to a duct between the outdoor heat exchanger 180 and the expansion valve 160. Another conduit 28 is connected between the lids 2, 3 for normally communicating the first pressure converting chamber $R_2$ with the second pressure converting chamber $R_3$.

The first five-way valve 102 described above is characterized in that not only sliding operation of the slider valve 21 but also opening/closing operation of the defrosting valve 24 can be controlled by a differential pressure which is caused by the pressures between the high pressure chamber $R_1$ and the first and second pressure converting chambers $R_2$, $R_3$ by turning on and off the electromagnetic valve 16.

COOLING MODE OF FIRST 5-WAY VALVE

FIG. 2A illustrates a cooling mode of the first five-way valve 102. In this cooling mode, the electromagnetic valve 16 is in its turned off condition so that the plunger 17 thereof is held, under the urging force of the compression spring 20, at its left limit position at which the needle valve body 17 closes the pressure venting hole 3A of the lid 3. Consequently, the high pressure chamber $R_1$ and the first pressure converting chamber $R_2$ exhibit an equal pressure due to their mutual communication by way of the pressure-equalizing hole 12A in the piston 12. Accordingly, the piston 12 is slid, under the spring force of the compression spring 13, until its left limit position at which it contacts with the valve seat 11 and the slider valve 21 establishes the communication between the through holes 11A and 11C of the valve seat 11 as seen in FIG. 2A. Consequently, the high temperature and high pressure refrigerant will be circulated from the compressor 120 via the first valve port 5, third valve port 7, outdoor heat exchanger 180, expansion valve 160, indoor heat exchanger 40, fourth valve port 8 and second valve port 6 back to the compressor 120.

Front surfaces P, Q and a rear surface X of the defrosting valve 24 are influenced over the entire areas thereof by a high pressure of the high temperature and high pressure refrigerant so that the defrosting valve 24 is held by receiving the urging force of the compression spring 25 to a position at which it closes the through hole 23A of the valve member 23.

Accordingly, in the cooling mode of the five-way valve 102, the fifth valve port 27 will not be supplied with the high temperature and high pressure refrigerant, and hence no defrosting operation is apparently performed.

CHANGING FROM COOLING MODE TO HEATING MODE

Now, when the cooling operation is stopped and then the electromagnetic valve 16 is turned on and the compressor 120 is actuated, the plunger 17 is electromagnetically retracted so that the needle valve body 18 opens the pressure venting hole 3A of the lid 3 so that the first pressure converting chamber $R_2$ defined within the piston 12 is communicated with the lower pressure of the inlet side of the compressor 120. Consequently, the high pressure gas (refrigerant) of the first pressure converting chamber $R_2$ starts to flow into the inlet side of the compressor 120 via the pressure venting hole 3A of the lid 3 and the conduit 14 while the high pressure gas of the second pressure converting chamber $R_3$ behind the defrosting valve 24 is allowed to similarly flow into the inlet side of the compressor 120 via the conduit 28 as well as the pressure venting hole 3A and the conduit 14 as seen from FIG. 2B.

Figure 2B:
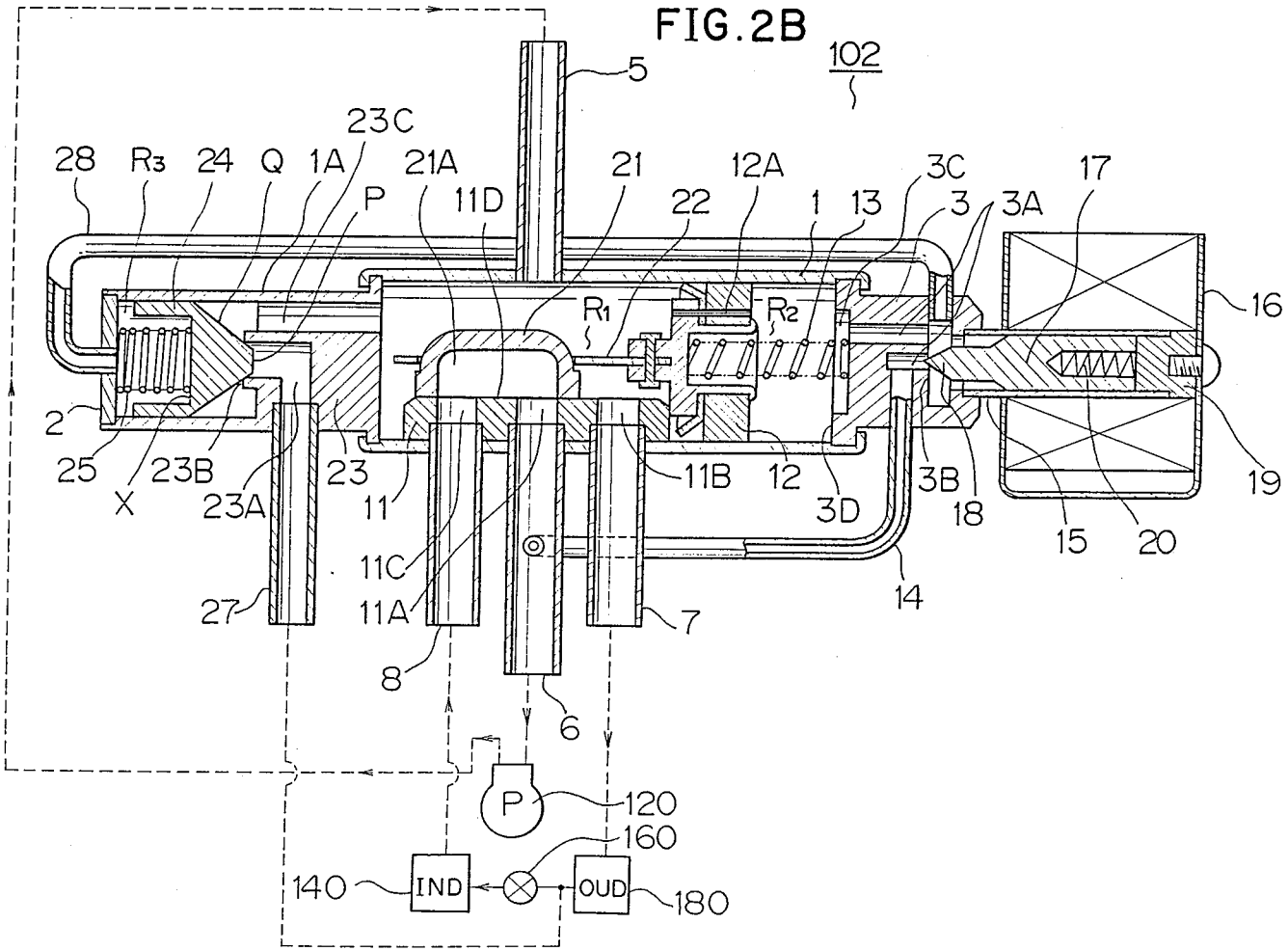
Figure 2C:
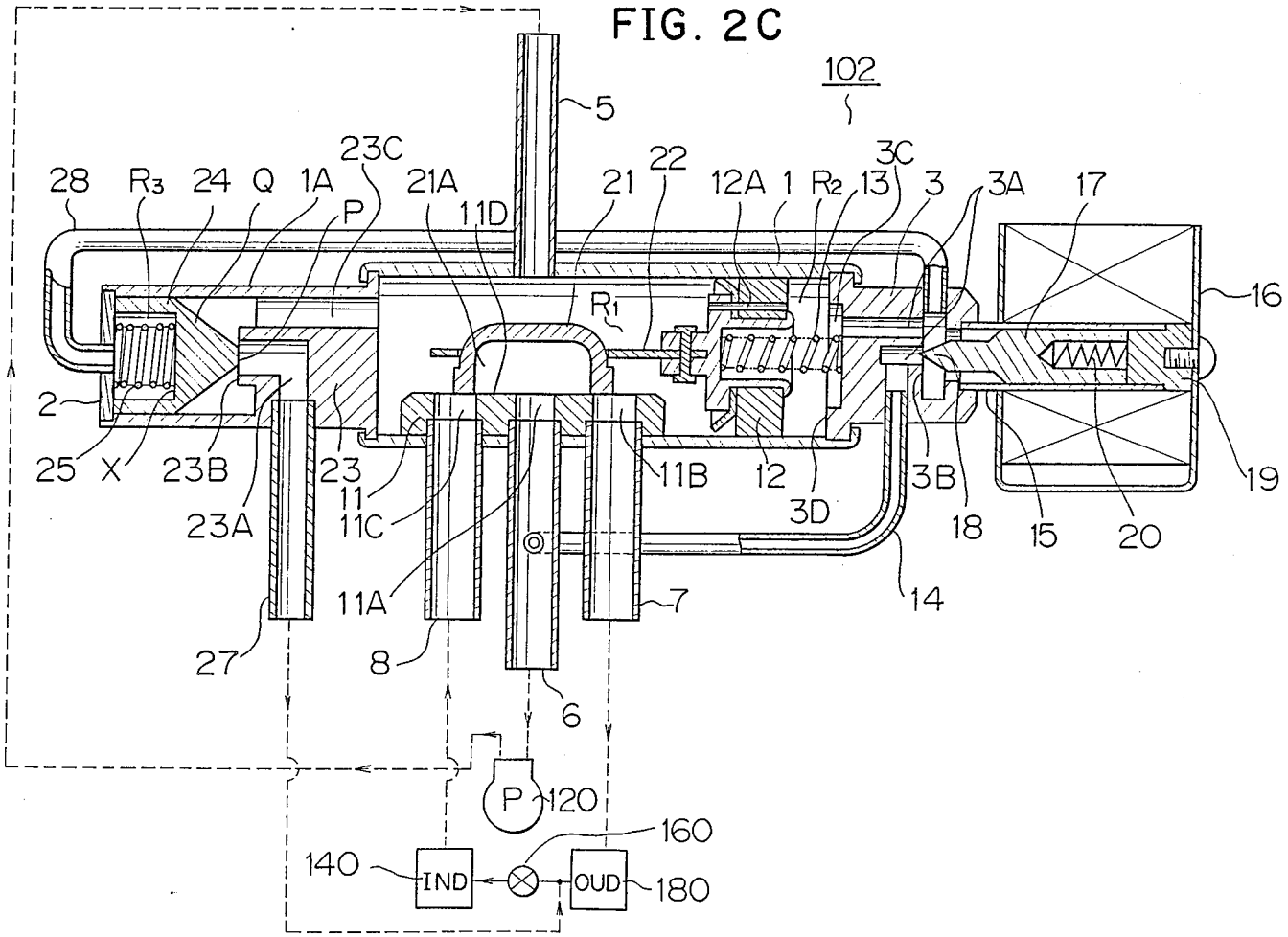

In the condition shown in FIG. 2B, at the first pressure converting chamber $R_2$, the refrigerant escapes therefrom to the inlet side (i.e., the gas intake side) of the compressor 120 via the pressure venting hole 3A of the lid 3 while at the same time it is supplied from the high pressure chamber $R_1$ via the pressure-equalizing hole 12A of the piston 12. In this instance, since the diameter of the pressure venting hole 3A is greater than that of the pressure-equalizing hole 12A, the discharging rate of the refrigerant from the first pressure converting chamber $R_2$ is greater than the supplying rate thereof to the first pressure converting chamber $R_2$ so that the pressure within the first pressure converting chamber $R_2$ becomes lower than that within the high pressure chamber $R_1$ until a difference in pressure which defeats the urging force of the compression spring 13, appears between the high pressure chamber $R_1$ and the first pressure converting chamber $R_2$. In other words, an amount of the refrigerant gas flown from the high pressure chamber $R_1$ into the first pressure converting chamber $R_2$ is smaller than that flown from the first pressure converting chamber $R_2$ into the inlet of the compressor 120 via the conduit 14. Consequently, both the piston 12 and the slider valve 21 start their movement toward the lid 3 (in the rightward direction as viewed in FIG. 2B). Similarly, the pressure within the second pressure converting chamber $R_3$ is decreased so that a difference in pressure which defeats the urging force of the compression spring 25, appears between the high pressure chamber $R_1$ and the second pressure converting chamber $R_3$ and slids the defrosting valve 24 toward the lid 2 (in the leftward direction as viewed in FIG. 2B) to its fully open position as seen in FIG. 2C. Precisely speaking, the surface Q of the defrosting valve 24 receives the high pressure of the refrigerant gas in the high pressure chamber $R_1$ via the passage 23C. As a result, the above-described differential pressure is produced inside the second pressure converting chamber $R_3$, and thus the defrosting valve 24 is slid against the spring force of the compression spring 25.

HEATING MODE OF FIRST 5-WAY VALVE

Figure 2D:
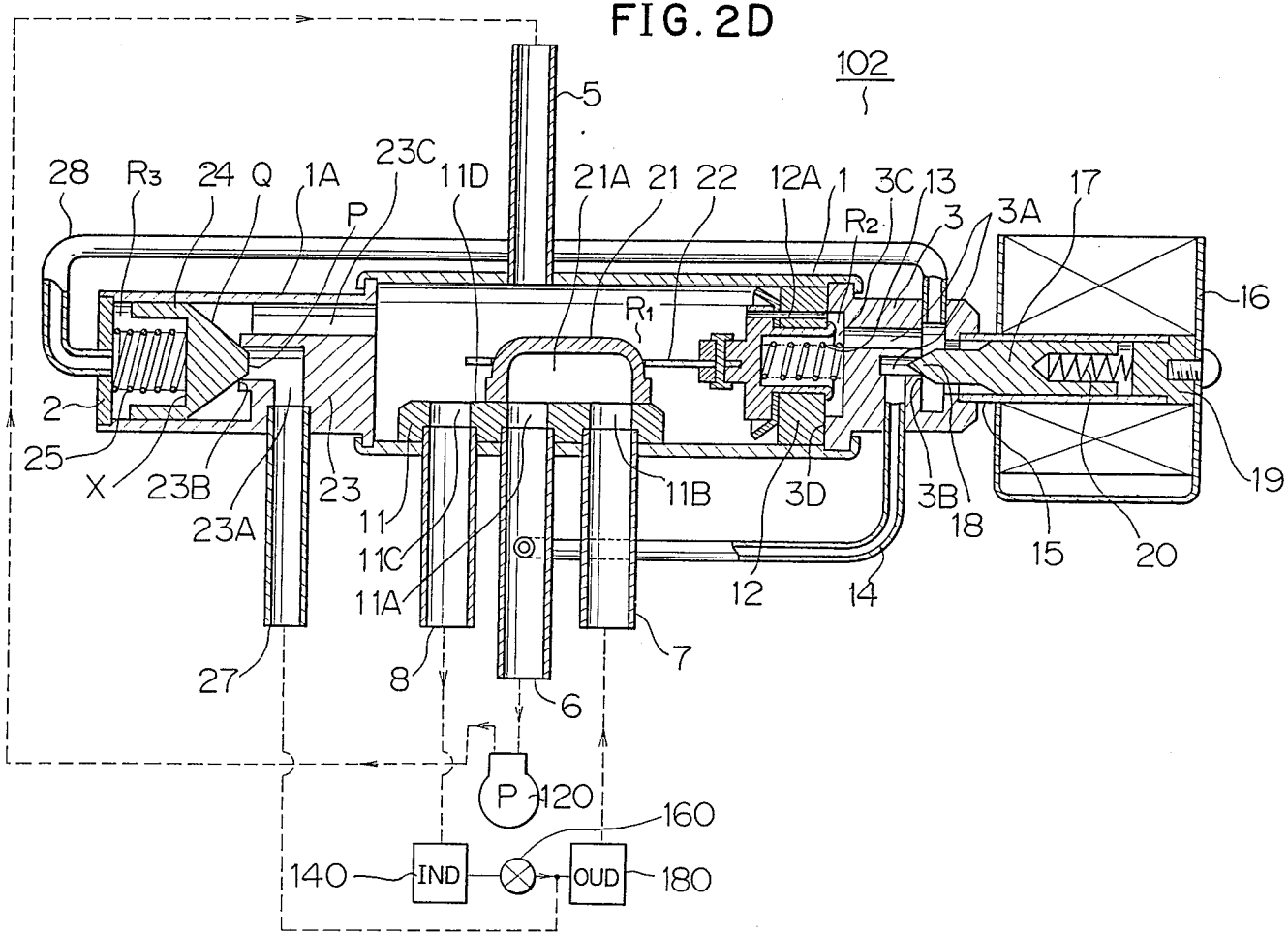

As approximately 1 minute has passed after turning on the electromagnetic valve 16, the movement of the piston 12 and the slider valve 21 toward the lid 3 (in the rightward direction as viewed in FIG. 2D) has been completed. Consequently, the slider valve 21 now communicates the through hole 11A with the through hole 11B of the valve seat 11 as seen in FIG. 2D. As a result, the refrigerating system now performs heating operation wherein the high temperature and high pressure refrigerant is circulated from the compressor 120 via the first valve port 5, fourth valve port 8, indoor heat exchanger 140, expansion valve 160, outdoor heat exchanger 180, third valve port 7 and second valve port 6 back to the inlet of the compressor 120.

In this condition, the electromagnetic valve 16 is turned off in order to close the pressure venting hole 3A of the lid 3 (see FIG. 2D). The lid 3 has, on a side thereof opposing to the piston 12, a contacting face 3D for contacting with the piston 12 with a recess 3C left therein. In heating operation of the five-way valve 102, since the pressure receiving area of the piston 12 on the first pressure converting chamber $R_2$ side is decreased, the pressure on the high pressure chamber $R_1$ side will defeat the pressure on the first pressure converting chamber $R_2$ side including the urging force of the compression spring 13 so that the piston 12 can be fixed against the lid 3. Since in this instance the second pressure converting chamber $R_3$ presents a high pressure again due to the pressure equalizing hole 12A, a resultant force in addition to the urging force of the compression spring 25 acts to fix the defrosting valve 24 to its valve closing position against the valve seat 23B of the defrosting valve member 23. It is to be noted that since the face P of the defrosting valve 24 opposing to the through hole 23A of the defrosting valve member 23 is acted upon by a low pressure at the inlet side of the outdoor heat exchanger 180 which is now operated as a evaporator, the defrosting valve 24 is held to the fixed position.

DEFROSTING MODE OF FIRST 5-WAY VALVE

Figure 2E:
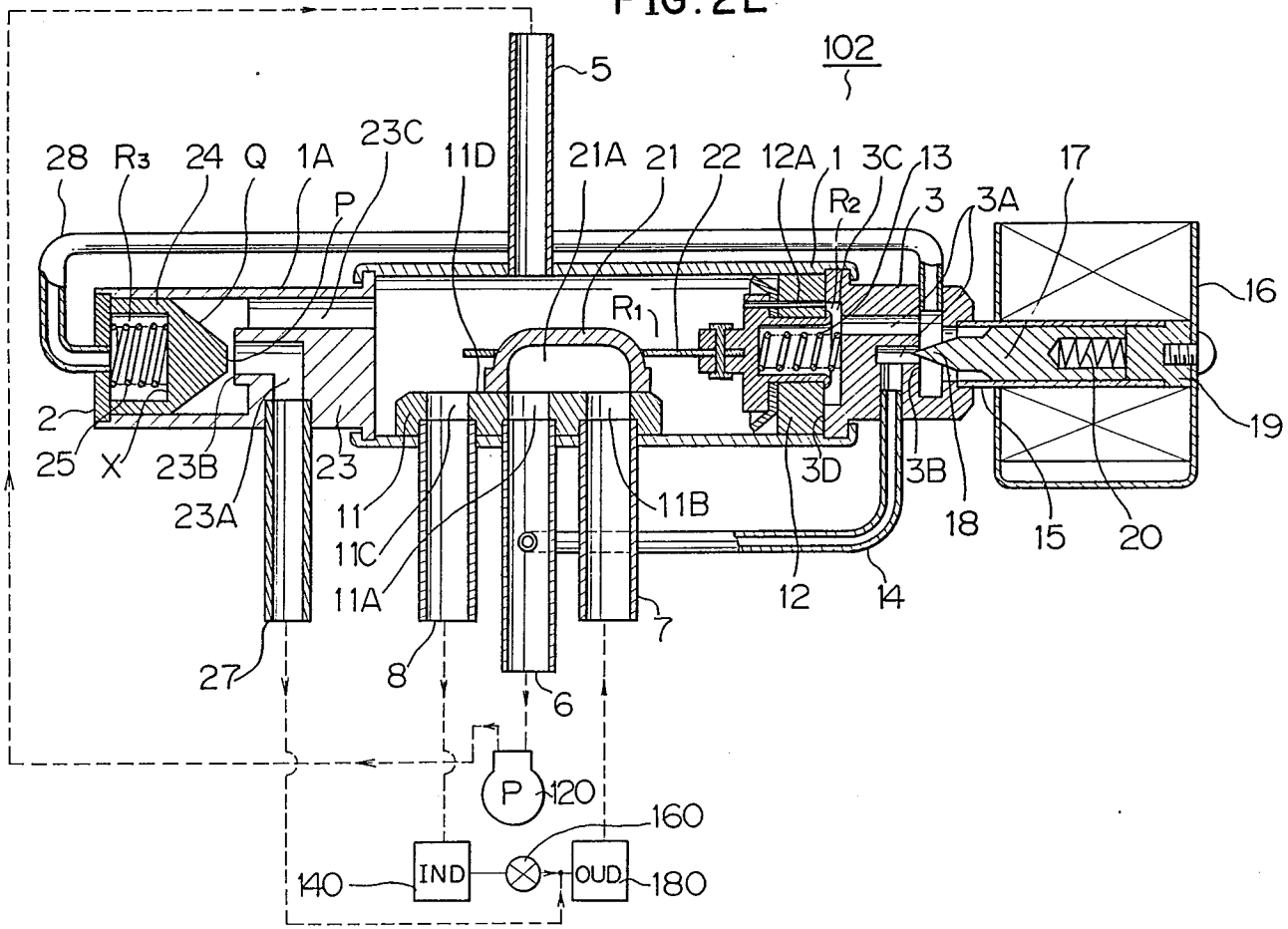

In case some frost appears on the outdoor heat exchanger 180 during the heating mode of the refrigerating system as illustrated in FIG. 2D, it is necessary to open the electromagnetic valve 16 for a predetermined period of time in order to remove the frost. To this end, the electromagnetic valve 16 is energized to open the pressure venting hole 3A of the lid 3 as seen in FIG. 2E. Consequently, both the pressures within the first and second pressure converting chambers $R_2$, $R_3$ are lowered so that the defrosting valve 24 is opened under the influence of the pressure in the high pressure chamber $R_1$. As a result, the high temperature and high pressure gas within the high pressure chamber $R_1$ is fed in a direction of an arrow indicated in FIG. 2E via the fifth value port 27 to the outdoor heat exchanger 180. Consequently, a part of the high temperature and high pressure gas is supplied to the evaporator of the outdoor heat exchanger 180 so that the frost sticking to the evaporator will be fused and thus removed from the evaporator. According to the present invention, the particular advantage exists in that the indoor heat exchanger 140 can still continue its heating operation.

After a predetermined period of time has passed, the electromagnetic valve 16 is deenergized in order to close the pressure venting hole 3A of the lid 3 with the needle valve body 18 after completion of the intended defrosting operation. Consequently, the pressures within the first and second pressure converting chambers $R_2$, $R_3$ are again raised to the high level due to the high pressure refrigerant gas introduced into the chambers $R_2$, $R_3$ via the pressure equalizing hole 12A and escaping hole 3A so that the defrosting valve 24 is closed again thereby to return the refrigerating system to its normal heating operation as seen in FIG. 2D.

The first five-way valve 102 according to the present invention described above is characterized in that, using a slider valve 21 connected to a slider valve actuating piston 12 which is interposed between a high pressure chamber $R_1$ and a first pressure converting chamber $R_2$ of a valve body 1 and is switched by opening or closing an electromagnetic valve 16 interposed in a pressure venting passage 14 from the first pressure converting chamber $R_1$ to the inlet side of a compressor 120, the electromagnetic valve 16 which is held in its closed condition during heating operation of the five-way valve 102, is opened so as to open a defrosting valve located so as to receive the pressure of the first pressure converting chamber $R_2$ and the pressure of the high pressure chamber $R_1$ in order to supply high temperature and high pressure gas to the outdoor heat exchanger 180. As a result, the outdoor heat exchanger 180 can be defrosted while the refrigerating system continues its heating operation. Since in this instance the defrosting valve 24 can be operated using the electromagnetic valve 16 for switching cooling/heating operations, the five-way valve 102 is advantageous in that it can be operated readily and can be simplified in construction.

CONSTRUCTION OF SECOND 5-WAY VALVE

Figure 3A:
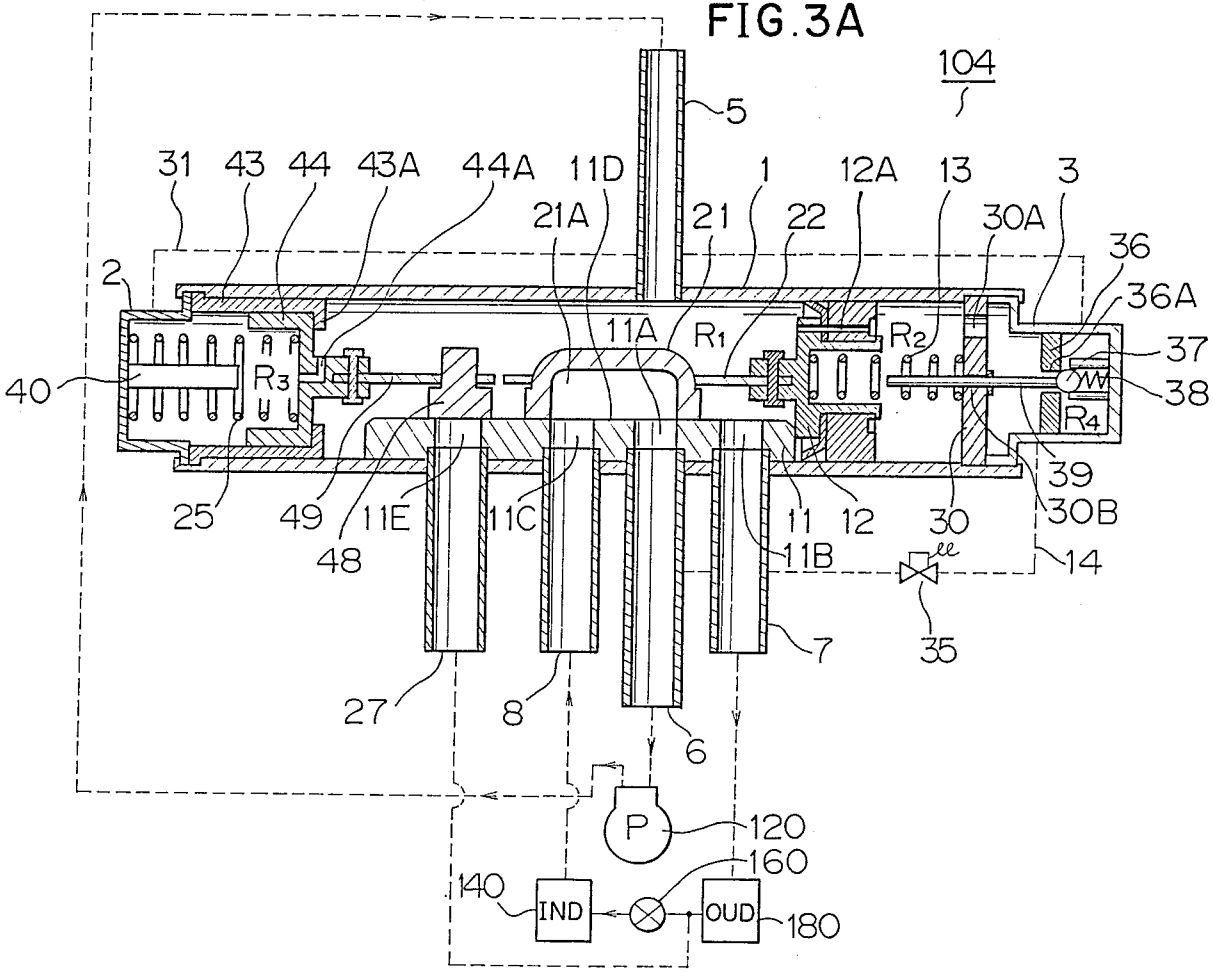
FIGS. 3A to 3C schematically show a five-way valve 104 according to a second preferred embodiment, where the cooling, heating and defrosting modes of the valve are illustrated.

Referring now to FIG. 3A, there is shown a construction of a five-way valve 104 according to a second preferred embodiment of the present invention.

As apparently seen from FIG. 3A, the construction of the five-way valve 104 is similar to that of the first five-way valve 102 shown in FIGS. 2A to 2E. Accordingly, like parts or components are denoted by like reference numerals to those of the first five-way valve 102 and detailed description thereof may be omitted herein to avoid redundancy.

The five-way valve 104 of FIG. 3A includes a first piston 12 mounted for sliding movement in a cylindrical valve body 1 along the longitudinal axis of the cylindrical valve body 1 between a valve seat 11 and a wall 30 adjacent a lid 3. The first piston 12 thus partitions the inside space of the cylindrical valve body 1 to define a high pressure chamber $R_1$ and a first pressure converting chamber $R_2$ A compression spring 13 is interposed between the first piston 12 and the wall 30 to normally urge the first piston 12 toward the high pressure chamber $R_1$ (in a leftward direction as viewed in FIG. 3A). The first piston 12 has a pressure-equalizing hole 12A for normally communicating the high pressure chamber $R_1$ with the first pressure converting chamber $R_2$. On the other hand, the wall 30 has formed therein a through hole 30A of a greater diameter than that the pressure-equalizing hole 12A of the first piston 12. A conduit 14 (indicated in broken line in FIG. 3A) constituting a pressure venting passage to the second valve port 6 of the compressor 120 is connected to the lid 3. An electromagnetic valve 35 is interposed in the conduit 14.

A separator 36 is located in the lid 3 to define a third pressure converting chamber $R_4$. An auxiliary valve body 37 for opening and closing a valve port 36A formed in the separator 36 is located in the third pressure converting chamber $R_4$ and is normally urged in a direction to close the valve port 36A (in a leftward direction as viewed in FIG. 3A) by means of a compression spring 38. A valve opening actuating rod 39 for the auxiliary valve body 37 is supported for sliding movement in a supporting hole 30B formed in the wall 30.

Configurations of a slider valve 21 and first to fourth valve ports 5 to 8 for communication with the slider valve 21 are similar to those of the first five-way valve 102 described hereinabove and accordingly description thereof is omitted herein.

An inside cylinder 43 is located within the cylindrical valve body 1 adjacent a left-hand side lid 2, and a second piston 44 is mounted for sliding movement within the inside cylinder 43 in a direction of the longitudinal axis of the valve body 1 between a stopper 43A of the inside cylinder 43 and the lid 2. Thus, a second pressure converting chamber R is defined by and between the second piston 44 and the lid 2. A compression spring 25 is interposed between the second piston 44 and the lid 2 to urge the second piston 44 toward the high pressure chamber $R_1$ (in the rightward direction as viewed in FIG. 3A).

An additional through hole 11E is formed in the valve seat 11 of the cylindrical valve body 1, or within the high pressure chamber $R_1$ and a fifth valve port 27 connected to a duct between the outdoor heat exchanger 180 and the expansion valve 160 is connected to the through hole 11E.

A defrosting valve 48 for opening and closing the through hole 11E is mounted for sliding movement on the valve seat 11 and connected for integral movement with the second piston 44 by means of a connecting rod 49. The second piston 44 has a pressure-equalizing hole 44A formed therein for communicating the high pressure chamber $R_1$ with the second pressure converting chamber $R_3$, and a closing member 40 for closing the pressure-equalizing hole 44 is fixed in the second pressure converting chamber $R_3$. A conduit 31 extends between the lids 2, 3 for normally communicating the second and third pressure converting chambers $R_3$, $R_4$ with each other.

The second five-way valve 104 described above is characterized in that not only sliding operation of the slider valve 21 for switching the cooling/heating modes but also operation of the defrosting piston 44 as well as the defrosting valve 48 can be controlled by the differential pressure appearing between the high pressure chamber $R_1$ and the first to third pressure converting chambers $R_2$ to $R_4$ by turning on/off the electromagnetic valve 35 under the conditions of the diameters of the pressure equalizers 12A, 30A, 44A.

COOLING MODE OF SECOND 5-WAY VALVE

FIG. 3A illustrates the cooling mode of the second five-way valve 104. In the condition shown in FIG. 3A, the electromagnetic valve 35 is in its turned off condition so that it closes the pressure venting conduit 14. Consequently, the high pressure chamber $R_1$ and the first pressure converting chamber $R_2$ exhibit an equal pressure due to their mutual communication by way of the pressure-equalizing hole 12A in the first piston 12. Accordingly, the first piston 12 assumes, under the urging force of the compression spring 13, its left limit position at which it contacts with the valve seat 11 and the slider valve 21 establishes the communication between the through holes 11A and 11C of the valve seat 11 as seen in FIG. 3A. Consequently, the high temperature and high pressure refrigerant is circulated from the compressor 120 via the first valve port 5, third valve port 7, outdoor heat exchanger 180, expansion valve 160, indoor heat exchanger 140, fourth valve port 8 and second valve port 6 back to the compressor 120. Meanwhile, due to the communication by way of the pressure-equalizing hole 44A of the defrosting piston 44, the high pressure chamber Rhd 1, the second pressure converting chamber $R_2$ and the third pressure converting chamber $R_4$ communicating with the second pressure converting chamber $R_3$ via the conduit 31, represent an equal pressure. Accordingly, the second piston 44 assumes, under the urging force of the compression spring 25, its right limit position in which it contacts with the stopper 43A of the inside cylinder 43 and accordingly the defrosting valve 48 connected thereto closes the through hole 11E of the valve seat 11.

HEATING MODE OF SECOND 5-WAY VALVE

Now, when the cooling operation is stopped and then the electromagnetic valve 35 is turned on to open the conduit 14 constituting a pressure venting passage and the compressor 120 is started, the high temperature and high pressure refrigerant gas of the first pressure converting chamber $R_2$ starts to flow into the inlet side (i.e., the second valve port 6) of the compressor 120 via the conduit 14 because the first pressure converting chamber $R_2$ is communicated with the inlet side of the compressor 120 in the lower pressure condition.

In this condition, in the first pressure converting chamber $R_2$, the refrigerant gas escapes therefrom to the inlet side of the compressor 120 via the through hole 30A of the wall 30 and the conduit 14 while at the same time it is supplied thereinto from the high pressure chamber $R_1$ via the pressure-equalizing hole 12A of the first piston 12. In the preferred embodiment, since the diameter of the through hole 30A and the diameter of the conduit 14 are greater than that of the pressure-equalizing hole 12A, the discharging rate (i.e., the exhausting amount) of the refrigerant gas from the first pressure converting chamber $R_2$ is greater than the supplying rate (i.e., the intaking amount) to the first pressure converting chamber $R_2$ so that the pressure within the first pressure converting chamber $R_2$ becomes lower than that within the high pressure chamber $R_1$ until a difference in pressure which defeats the urging force of the compression spring 13 appears between the high pressure chamber $R_1$ and the first pressure converting chamber $R_2$. Consequently, the first piston 12 and the slider valve 21 start their sliding movement toward the wall 30.

Figure 3B:
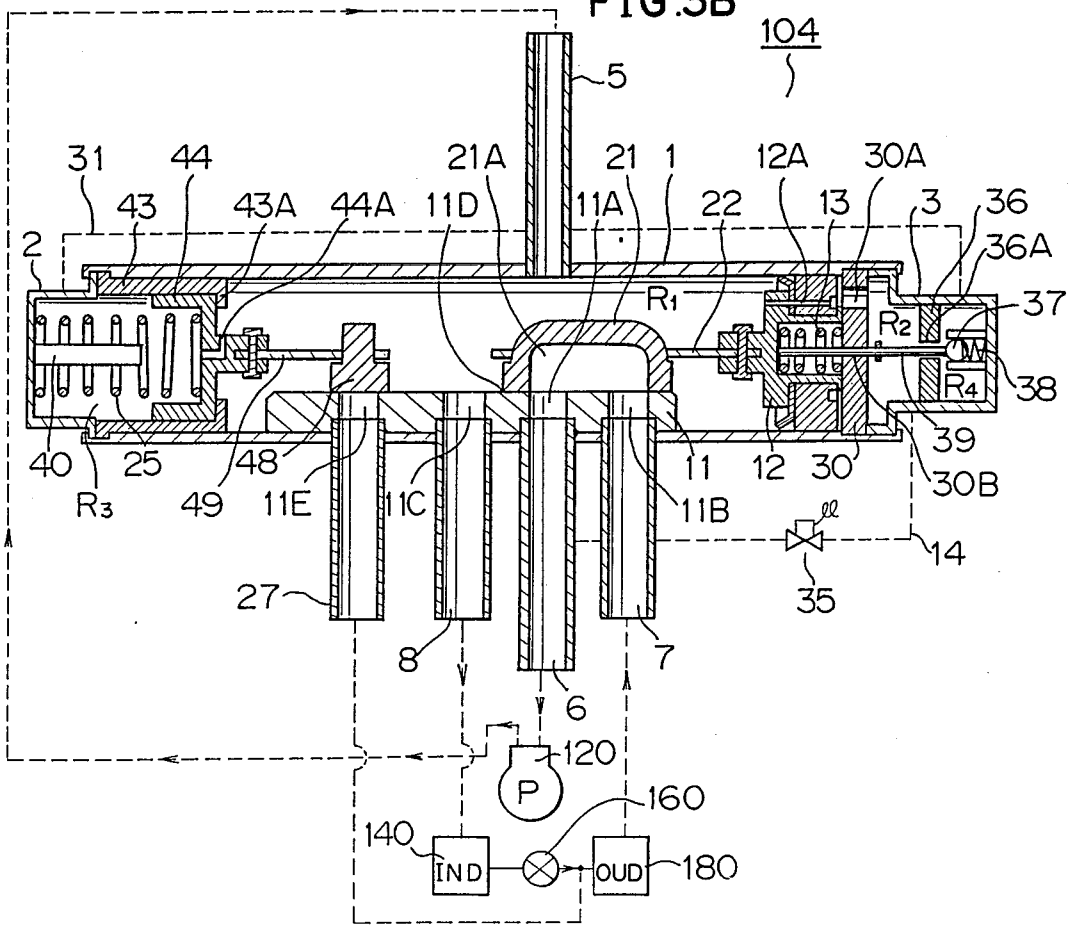

When the differential pressure reaches a predetermined level after turning on the electromagnetic valve 35, the sliding movement of the first piston 12 and the slider valve 21 toward the wall 30 is accomplished. Consequently, the slider valve 21 now communicates the through hole 11A connected to the inlet side of the compressor 120 with the through hole 11B to the third valve (inlet) port 7 of the outdoor heat exchanger 180 as seen in FIG. 3B. As a result, the refrigerating system now performs its heating operation wherein the high temperature and high pressure refrigerant is circulated from the compressor 120 via the first valve port 5, fourth valve port 8, indoor heat exchanger 140, expansion valve 160, outdoor heat exchanger 180, third valve port 7 and second valve port 6 back to the compressor 120. Under such a condition, the electromagnetic valve 35 is turned off in order to close the conduit 14. In this condition, the piston 12 is fixed in the predetermined position due to another differential pressure appearing between the high pressure outside the slider valve 21 (i.e., the high pressure of the high pressure chamber $R_1$) and the low pressure (i.e., the pressure in the inlet side of the compressor 120) within the connecting concave 21A of the slider valve 21 (see FIG. 3B).

Sliding operation of the first piston 12 will now be described more in detail.

Just before the first piston 12 is brought into contact with the wall 30, it will push the valve opening actuating rod 39 to move axially rightwardly in FIG. 3A to open the auxiliary valve body 37 against the compression spring 38 thereby to communicate the second and third pressure converting chambers $R_3$, $R_4$ with the low pressure side of the compressor 120. Then it produces a flow of the refrigerant to the inlet side of the compressor 120. In this case, the ratio between the rates of a refrigerant flow through th pressure-equalizing hole 44A of the second piston 44 and a refrigerant flow through the conduit 14 communicating with the inlet port of the compressor 120 is selected in such a manner that, until a pressure of, for example, $\Delta P$ is reached to 6 $kg/cm^2$, the the second piston 44 may maintain such a relationship that the above-defined piston pressure multiplied by an effective area of the second piston 44 is equal to or smaller than the urging force of the compression spring 25. Under this condition, the second piston 44 and hence the defrosting valve 48 are rendered inoperative by closing the electromagnetic valve 35.

DEFROSTING MODE OF SECOND 5-WAY VALVE

Figure 3C:
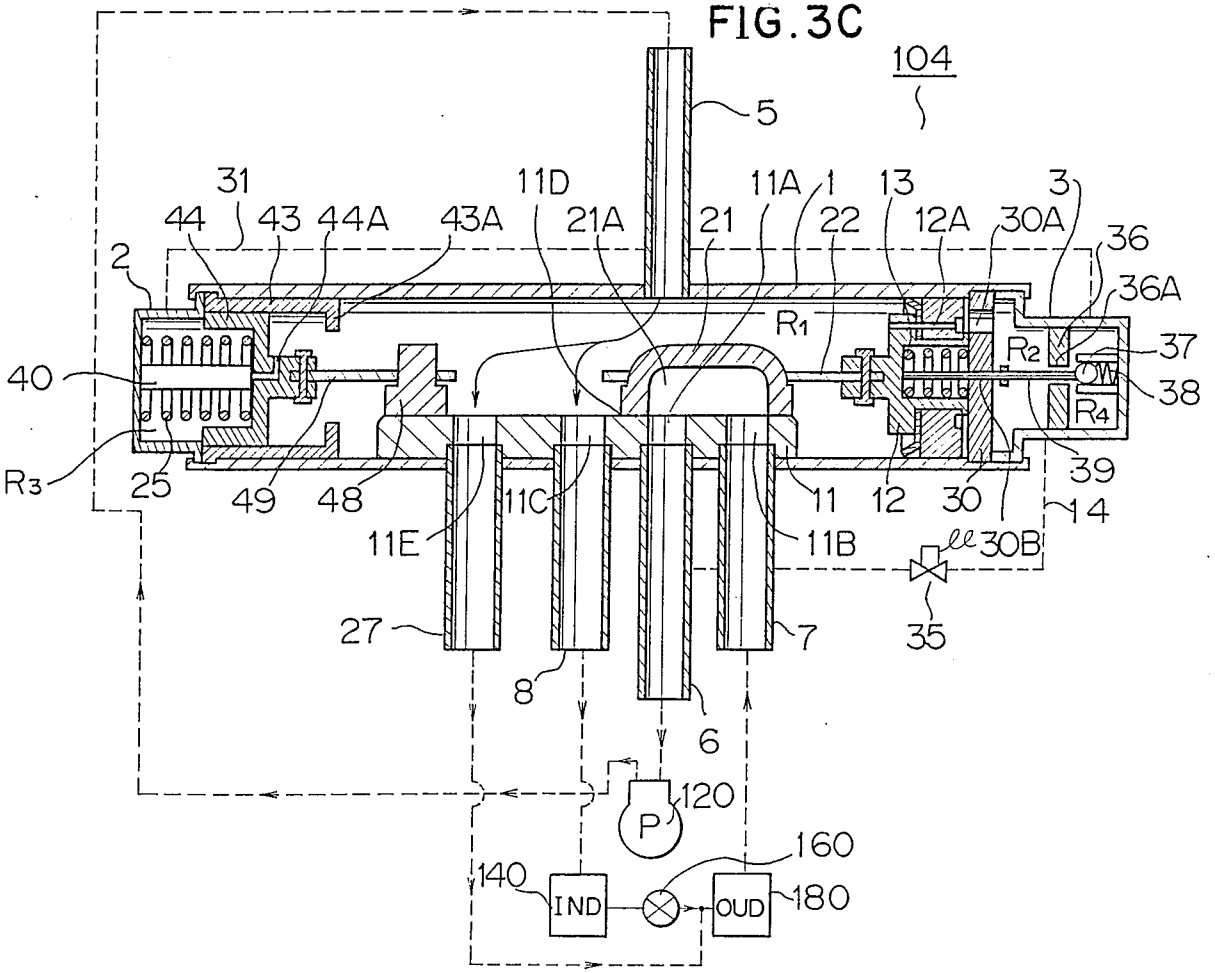

Similarly as in the first five-way valve 102 described hereinabove, in case some frost appears on the outdoor heat exchanger 180 acting as an evaporator during the heating mode of the indoor heat exchanger 140, it is required to open the electromagnetic valve 35 for a predetermined period of time in order to remove the frost. To this end, the electromagnetic valve 35 is energized to open the conduit 14 communicating with the inlet port (the second valve port 6) of the compressor 120. Consequently, the pressure within the first and third pressure converting chambers $R_2$, $R_4$ is decreased. Since the first and second pressure converting chambers $R_2$, $R_3$ are communicated with each other by the conduit 31 and the pressure-equalizing hole 36A of the separator 36, the pressure within the second pressure converting chamber $R_3$ is accordingly decreased. Consequently, a differential pressure will appear between the high pressure chamber $R_1$ and the second pressure converting chamber $R_3$, i.e., between the inside and outside of the second piston 44, respectively. When the force caused by this differential pressure increases, e.g., more than 6 $kg/cm^2$ until it defeats the urging force of the compression spring 25 and the frictional resistance of the defrosting valve 48, it will move the second piston 44 and hence the defrosting valve 48 in the leftward direction as viewed in FIG. 3B to their respective left limit positions in which the through hole 11E of the valve seat 11 is open as seen in FIG. 3C. As a result, the high temperature and high pressure refrigerant gas within the high pressure chamber $R_1$ is fed in a direction of an arrow indicated in FIG. 3C via the fifth valve port 27 to the outdoor heat exchanger 180 thereby to effect defrosting of the outdoor heat exchanger 180. At the moved left limit position of the second piston 44, the pressure-equalizing hole 44A thereof is closed by the closing member 40 as seen in FIG. 3C in order to prevent a possible reduction of the aforementioned differential pressure while the defrosting valve 48 is opened. By this reason, the defrosting valve 48 can be fixed to its defrosting position.

After a predetermined period of time has passed, the electromagnetic valve 16 is closed so that the first, second and third pressure converting chambers $R_2$, $R_3$, $R_4$ are returned to their respective high pressure conditions. Consequently, the defrosting valve 44 is closed again so that the refrigerating system is returned to its normal heating operation as shown in FIG. 3B.

In summary, the second five-way valve 104 comprises a cylindrical valve body, first and second pistons for partitioning the inside of the cylindrical valve body to define a high pressure chamber and first and second pressure converting chambers, a connecting hole to the outlet port of a compressor and another connecting hole to the inlet port of the compressor being provided for the high pressure chamber, two further connecting holes to conduits for an outdoor heat exchanger and an indoor heat exchanger being provided for the high pressure chamber at opposite positions with respect to the connecting hole to the inlet port of the compressor, a switching valve seat extending over a range of the connecting hole to the inlet port of the compressor and the connecting holes to the conduits for the outdoor and indoor heat exchangers, a slider valve mounted for sliding movement along the switching valve seat and connected to the first piston, a defrosting valve mounted for movement in the high pressure chamber to open and close a through hole to another conduit to the outdoor heat exchanger and connected to the second piston, the first and second pistons having pressure-equalizing holes formed therein for communicating the high pressure chamber with the first and second pressure converting chambers, respectively, a pair of springs for urging the first and second pistons toward the high pressure chamber, a pressure venting passage having a greater diameter than the pressure equalizing holes and connected to the first pressure converting chamber so as to communicate with the inlet side of the compressor, an electromagnetic valve interposed in the pressure venting passage, a third pressure converting chamber being provided so as to communicate with the first pressure converting chamber via a valve port, and an auxiliary valve body urged to close the valve port and positioned such that it may be actuated to open the valve port by the first piston when the five-way valve is switched to its heating operation, the second and third pressure converting chambers communicating with each other. Accordingly, while the indoor heat exchanger continues its heating operation, defrosting of the outdoor heat exchanger can be performed. Since in this embodiment, not only the sliding operation of the slider valve but also actuation of the defrosting valve can be controlled using the electromagnetic valve for switching cooling/heating modes, i.e., the differential pressure, the five-way valve is advantageous in that it can be operated readily and can be simplified in construction.

DESCRIPTION OF THIRD 5-WAY VALVE

The first and second five-way valves 102, 104 according to the present invention described above employ an azeotropic refrigerant mixture or a single refrigerant as a refrigerant gas. To the contrary, a five-way valve 106 will now be described in detail which enables a defrosting operation of a reversible refrigerating system that employs a non-azeotropic refrigerant mixture as a refrigerant gas.

CONSTRUCTION OF THIRD 5-WAY VALVE

Figure 4A:
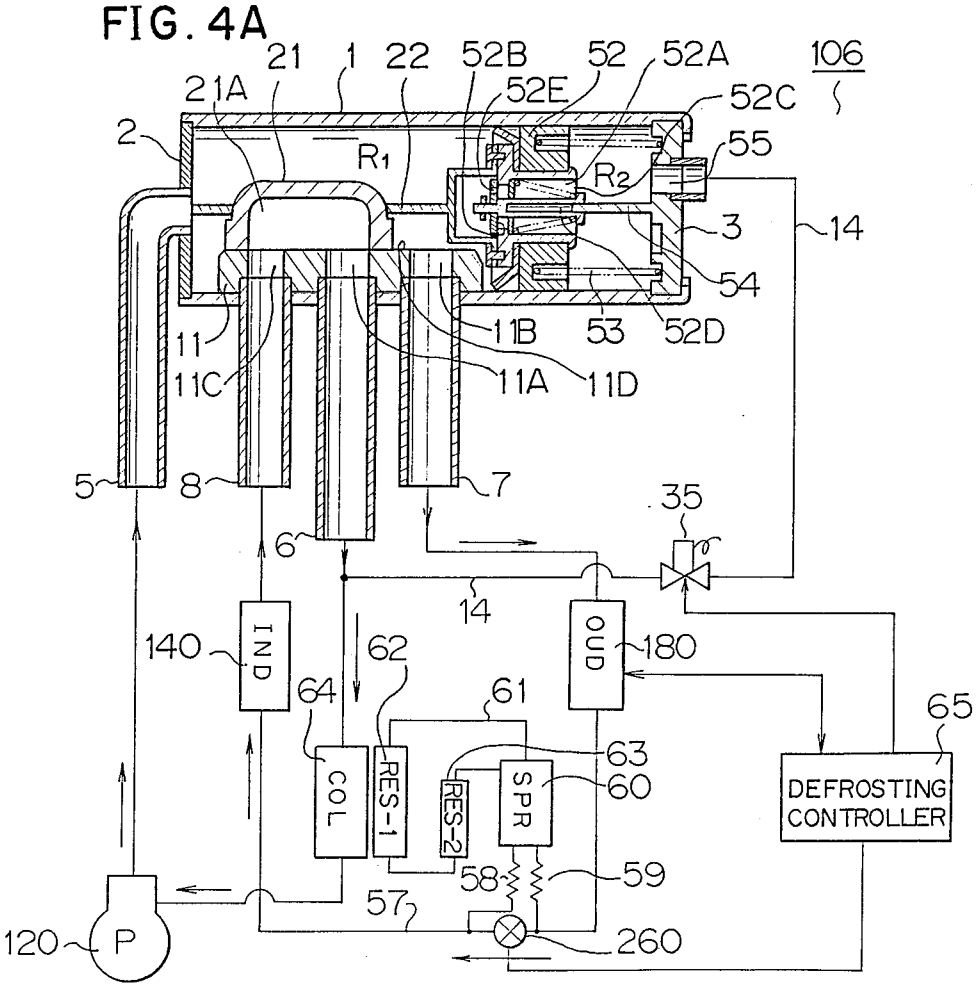
FIGS. 4A and 4B schematically show a five-way valve 106 according to a third preferred embodiment, where the cooling, heating and defrosting modes of a bleed valve 52B are illustrated.

Referring now to FIG. 4A, a construction of the five-way valve 106 according to a third preferred embodiment of the invention will be described.

The five-way valve 106 includes a piston 52 mounted for sliding movement along the longitudinal axis of a valve body 1 between a valve seat 11 and a lid 3. The piston 52 thus partitions the inside of the valve body 1 to define a high pressure chamber $R_1$ and a pressure converting chamber $R_2$. A compression spring 53 is interposed between the piston 52 and the lid 3 to normally urge the piston 52 toward the high pressure chamber $R_1$ (in the leftward direction as viewed in FIG. 4A). The piston 52 has a bleed hole 52A formed therein, and a bleed valve 52B is located in the piston 52 for opening and closing the bleed hole 52A. The bleed valve 52B is normally urged in a direction to close the bleed hole 52A by means of a compression spring 52C and has bore 52D formed therein. A supporting rod 54 is provided on the lid 3 and extends into the bore 52D of the bleed valve 52B so as to support the bleed valve 52B thereon. The bleed valve 52B has a pressure-equalizing hole 52E formed therein for normally communicating the high pressure chamber $R_1$ with the pressure converting chamber $R_2$ Meanwhile, the lid 3 has formed therein a pressure venting hole 55 having a greater diameter than that of the pressure-equalizing hole 52E, and a conduit 14 constituting a pressure venting passage to a first valve port 6 is connected to the pressure venting hole 55 of the lid 3. An electromagnetic valve 35 is interposed in the conduit 14.

An expansion valve 260 is interposed in a duct 57 between an outdoor heat exchanger 180 and an indoor heat exchanger 140. A pair of capillary pipes 58, 59 are connected to both ends of the expansion valve 260 and a separator 60 is connected to the other ends of the capillary pipes 58, 59. First and second reservoirs 62, 63 are connected to the separator 60 by way of conduits 61. The first reservoir 62 is located adjacent a cooler 64 which is interposed in the first valve port 6 from the five-way valve 06. In the present embodiment, a non-azeotropic refrigerant mixture of Fron (tradename) R-22 and R13B1 is employed as a refrigerant gas.

A slider valve 21 is mounted on a valve seat 11 and has a connecting concave 21A formed therein. The slider valve 21 is connected for integral movement with the piston 2 by means of a connecting rod 22. As the slider valve 21 moves in an axial direction, it communicates a through hole 11A to the first valve port 6 with one of through holes 11B, 11C formed in the valve seat 11.

The reason why the present arrangement employs two independent reservoirs 62, 63 is that the efficiency in heat transfer with the cooler 64 can be improved by this arrangement, as compared with another arrangement which employs a single reservoir having a capacity equal to a sum total of the capacities of the two reservoirs 62, 63. Besides, as the first reservoir 62 has an elongated configuration, comparing with the second reservoir 63 as seen in FIG. 4A, an advantage can be anticipated that the heat transfer efficiency can be further improved comparing with the arrangement wherein the two reservoirs have an equal capacity with each other.

COOLING MODE OF THIRD 5-WAY VALVE

In the preferred embodiment illustrated in FIG. 4A, the five-way valve 106 is set to the cooling mode which is usually performed during hot weather.

In the position shown in FIG. 4A, the electromagnetic valve 35 is in its closed position in which the conduit 14 is closed. Accordingly, the high pressure chamber $R_1$ and the pressure converting chamber $R_2$ exhibit an equal pressure because the high pressure refrigerant gas is flown into these chambers $R_1$ and $R_2$ via the pressure-equalizing hole 52E formed in the piston 52. Accordingly, the piston 52 assumes, under the urging force of the compression spring 53, its left limit position as viewed in FIG. 4A in which it contacts with the valve seat 11 and the slider valve 21 communicates the through hole 11A connected to the first valve port 6 of the compressor 120 with the through hole 11C connected to the fourth valve port 8 of the indoor heat exchanger 140. As a result, the high temperature and high pressure non-azeotropic refrigerant mixture is circulated from the compressor 120 via the first valve port third valve port 7, outdoor heat exchanger 180, expansion valve 260, indoor heat exchanger 140, fourth valve port 8 and finally second valve port 6 back to the compressor 120.

During cooling operation of the refrigerating system, since the temperature of the outdoor air is relatively high, one refrigerant component Fron R13B1 of the non-azeotropic refrigerant mixture is separated from the other refrigerant component Fron R-22, and is accumulated in the first and second reservoirs 62, 63.

HEATING MODE OF THIRD 5-WAY VALVE

Now, when the cooling operation of the refrigerating system is stopped and then the electromagnetic valve 35 is energized to open the pressure passage of the conduit 14 and furthermore the compressor 120 is started, the pressure converting chamber $R_2$ is communicated with the lower pressure of the first valve port 6 for the compressor 120 so that the high pressure refrigerant gas within the pressure converting chamber $R_2$ starts to flow to the first valve port 6 side of the compressor 120 via the pressure venting conduit 14. Under the condition, the refrigerant gas in the pressure converting chamber $R_2$ escapes to the first valve port 6 for the compressor 120 via the pressure venting passage 14, 55 while at the same time the non-azeotropic refrigerant is supplied from the high pressure chamber $R_1$ via the pressure-equalizing hole 52E of the piston 52 to the pressure converting chamber $R_2$. In this five-way valve 106, since the diameter of the conduit 14 constituting the pressure venting passage is greater than that of the pressure-equalizing hole 52E so that the amount of the refrigerant flow exhausted from the pressure converting chamber $R_2$ is greater than the amount of the refrigerant flow from the chamber $R_1$ to this chamber $R_2$, the pressure within the pressure converting chamber $R_2$ is lowered than that of the high pressure chamber $R_1$. Finally, a difference in pressure which defeats the urging force of the compression spring 53 will appear between the chambers $R_1$, $R_2$ so that the piston 52 and the slider valve 21 connected thereto will start their integral movement toward the lid 3 (in the rightward direction as viewed in FIG. 4A).

Figure 4B:
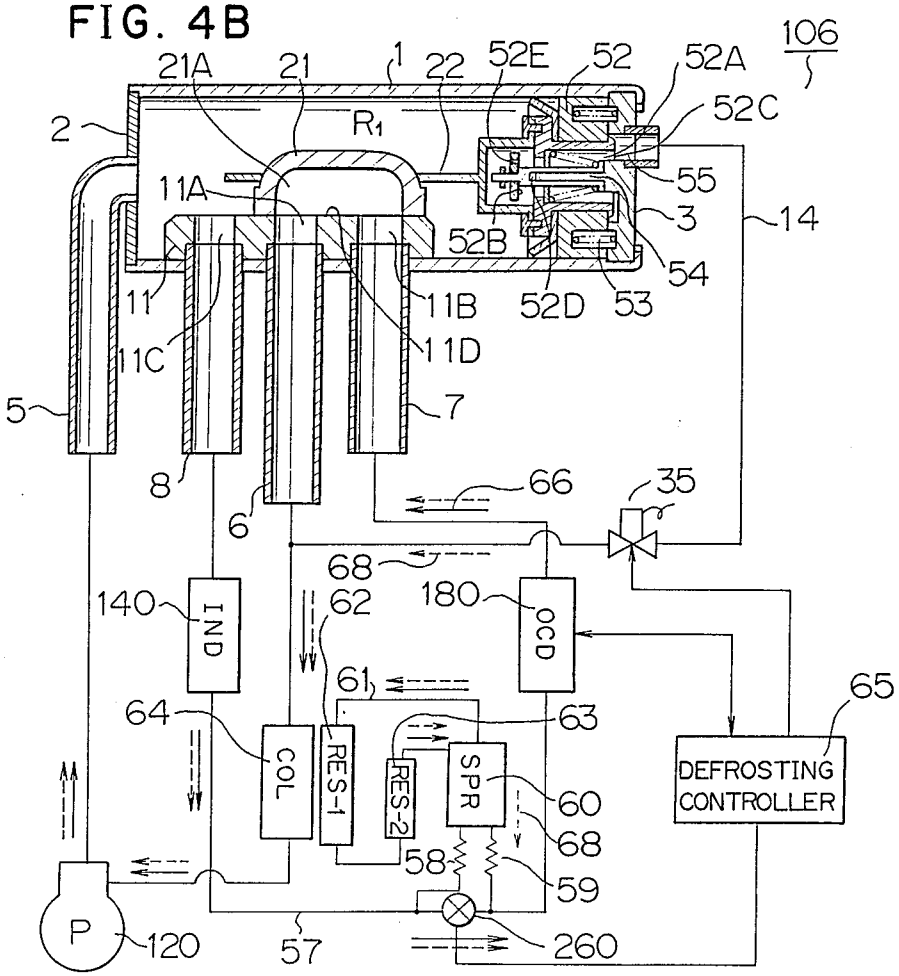

As a predetermined difference in pressure appears between the high pressure chamber $R_1$ and the pressure converting chamber $R_2$ after energization of the electromagnetic valve 35, the sliding operations of the piston 52 and the slider valve 21 toward the lid 3 are completed. In this position, the slider valve 21 communicates the through hole 11A of the valve seat 11 to the inlet side of the compressor 120 with the through hole 11A to the inlet side of the outdoor heat exchanger 180 as seen in FIG. 4B. As a result, the refrigerating system now performs a heating operation wherein the non-azeotropic refrigerant mixture is circulated in a direction as indicated by solid line 66 in FIG. 4B from the compressor 120 via the first valve port 5, fourth valve port 8, indoor heat exchanger 140, expansion valve 260, outdoor heat exchanger 180, third valve port 7 and second valve port 6 back to the compressor 120. Under this condition, the electromagnetic valve 35 is then turned off to close the pressure venting passage 14, 55. Consequently, the slider valve 21 is fixed in this heating position on the valve seat 11 due to a differential pressure between the outside (i.e., in the high pressure chamber $R_1$) and the inside (i.e., in the concave 21A) of the slider valve 21. It should be noted that, just before the piston 52 is stopped, the bleed valve 52B of the piston 52 is operated by the supporting rod 54 on the lid 3 thereby to open the bleed hole 52A.

During the heating mode of the refrigerating system, since the temperature of the outdoor air is relatively low due to cold weather, the Fron gases R-22 and R13B1 of the non-azeotropic refrigerant mixture are not separated from each other, and accordingly the mixture of the two gas components is accumulated in the first and second reservoirs 62, 63.

DEFROSTING MODE OF THIRD 5-WAY VALVE

When the defrosting is required during the heating mode of the five-way valve 106 as illustrated in FIG. 4B, the expansion valve 260 is fully opened to allow the non-azeotropic refrigerant mixture at the high pressure to flow directly to the outdoor heat exchanger 180, while at the same time the electromagnetic valve 35 is opened to allow the high pressure non-zerotropic refrigerant mixture to flow in a large quantity to the inlet port of the compressor 120. Consequently, the cooler 64 is heated by the high pressure non-azeotropic refrigerant mixture and in turn transfers its heat to the first reservoir 62. Consequently, the pressure of refrigerant gas within the first reservoir 62 increases so that the high pressure non-azeotropic refrigerant mixture will flow out of the first reservoir 62 and be introduced into the outdoor heat exchanger 180 via the second reservoir 63, separator 60 and capillary tube 59. As a result, the outdoor heat exchanger 180 is defrosted.

OPERATION OF DEFROSTING CONTROLLER

Such a defrosting operation is triggered by a defrosting starting signal supplied from a defrosting controller 65 (refer to FIG. 4B). In particular, the defrosting controller 65 successively measures rates of air ventilated by a fan of an evaporator (not specifically shown) of the outdoor heat exchanger 180. When the difference between the rates of ventilated air on the incoming side and the outgoing side of the fan exceeds a predetermined threshold value, the defrosting controller 65 delivers the defrosting starting signal to the electromagnetic valve 35 and the expansion valve 260. In response to the defrosting starting signal, the electromagnetic valve 35 is opened to allow the high temperature refrigerant gas to flow in a direction as indicated by a broken line 68 in FIG. 4B through the conduit 14. Consequently, the high temperature refrigerant gas is supplied to the cooler 64. Meanwhile, the expansion valve 260 which is connected for opening and closing operation by, for example, a stepper motor (not shown), is moved to its fully open position in response to the defrosting starting operation transferred from the defrosting controller 65. Consequently, the high temperature gas from the indoor heat exchanger 140 is now allowed to flow into the outdoor heat exchanger 180. On the other hand, when the desired defrosting operation is completed, the difference between the rates of ventilated air on the incoming and outgoing sides of the evaporator of the outdoor heat exchanger 180 becomes lower than the predetermined threshold value. Thus, the defrosting controller 65 now delivers a defrosting completion signal to the electromagnetic valve 35 and the expansion valve 260 in order to close the two valves 35, 260.

Even during defrosting operation, due to the fact that there is a pressure difference between the inside and the outside of the slider valve 21 and also that the inner diameter of the pressure venting passage 55 is greater than the inner diameter of the bleed hole 52A of the piston 52, a differential pressure is present on the piston 52, which is sufficient to defeat the total urging force of the compression springs 53 and 52C. Consequently, the piston 52 is fixed at the heating position as shown in FIG. 4B. Upon receipt of a defrosting completion signal from the defrosting controller 65, the electromagnetic valve 35 is deenergized and thus closed, thereby returning the refrigerating system to its normal heating mode. It should be noted that, among the inner diameters of the pressure-equalizing hole 52E, bleed hole 52A, electromagnetic valve 35 and pressure venting hole 55, there is a relationship of pressure-equalizing hole < bleed hole < diameter of electromagnetic valve ≦ pressure venting hole.

It should be also noted that while the refrigerating system shown in FIGS. 4A and 4B employs two reservoirs 62 and 63 with the former heat-coupled to the cooler 64, naturally it may otherwise employ a single reservoir therein.

In summary, the five-way valve 106 of the present embodiment is characterized in that it enables a reversible refrigerating system which employs a non-azeotropic refrigerant mixture as a refrigerant gas to perform a defrosting operation while continuing its heating operation by provision of a cooling/heating switching slider valve 21, a bleed valve 52B cooperating with the slider valve 21, a cooler 24 provided on the inlet port 6 side of a compressor 120, and two reservoirs 62, 63 for heat exchanging with the cooler 24.

In particular, the five-way valve 106 according to the third preferred embodiment is characterized in that it comprises a cylindrical valve body, a piston for partitioning the inside of the cylindrical valve body to define a high pressure chamber and a pressure converting chamber, a connecting hole to the outlet port of a compressor being provided for the high pressure chamber, two further connecting holes to conduits for an outdoor heat exchanger and an indoor heat exchanger being provided for the high pressure chamber at opposite positions with respect to the connecting hole to the outlet port of the compressor, a switching valve seat extending over a range of the connecting hole to the inlet port of the compressor and the connecting holes to the conduits for the outdoor and indoor heat exchangers, a slider valve mounted for sliding movement along the switching valve seat and connected to the piston, the piston having a pressure-equalizing hole formed therein for communicating the high pressure chamber with the pressure converting chamber, the piston further having formed therein a bleed hole of a greater diameter than that of the pressure-equalizing hole, a compression spring for urging the piston toward the high pressure chamber, a pressure venting passage provided for the pressure converting chamber so as to communicate with the inlet port side of the compressor and having a greater diameter than the bleed hole of the piston, an electromagnetic valve interposed in the pressure venting passage, and a bleed valve provided for the bleed hole of the piston and urged in a direction to normally close the bleed hole, whereby the bleed valve is automatically opened during switching to heating mode and then during heating operation, the electromagnetic valve is opened so that a greater amount of high pressure gas may be supplied to the inlet port than that during switching to cooling operation. Accordingly, by opening the electromagnetic valve during heating mode, the non-azeotropic refrigerant mixture accumulated in a reservoir is immediately heated so that it is brought into a refrigerating cycle and supplied to the outdoor heat exchanger in order to defrost the outdoor heat exchanger. Besides, this can be controlled using the electromagnetic valve for switching cooling-/heating modes. Accordingly, there is an advantage that a defrosting electromagnetic valve as is required in the preceding embodiments can be omitted.

CONSTRUCTION OF FOURTH 5-WAY VALVE

In FIGS. 5A to 5D, there is shown a five-way valve 108 according to a fourth preferred embodiment of the present invention.

Figure 5C:
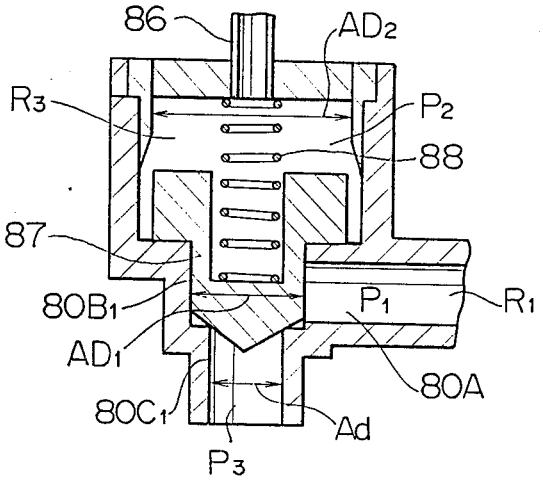
FIG. 5C is a cross sectional view of a defrosting valve 87 employed in the five-way valve 108 of FIG. 5A.
Figure 5A:
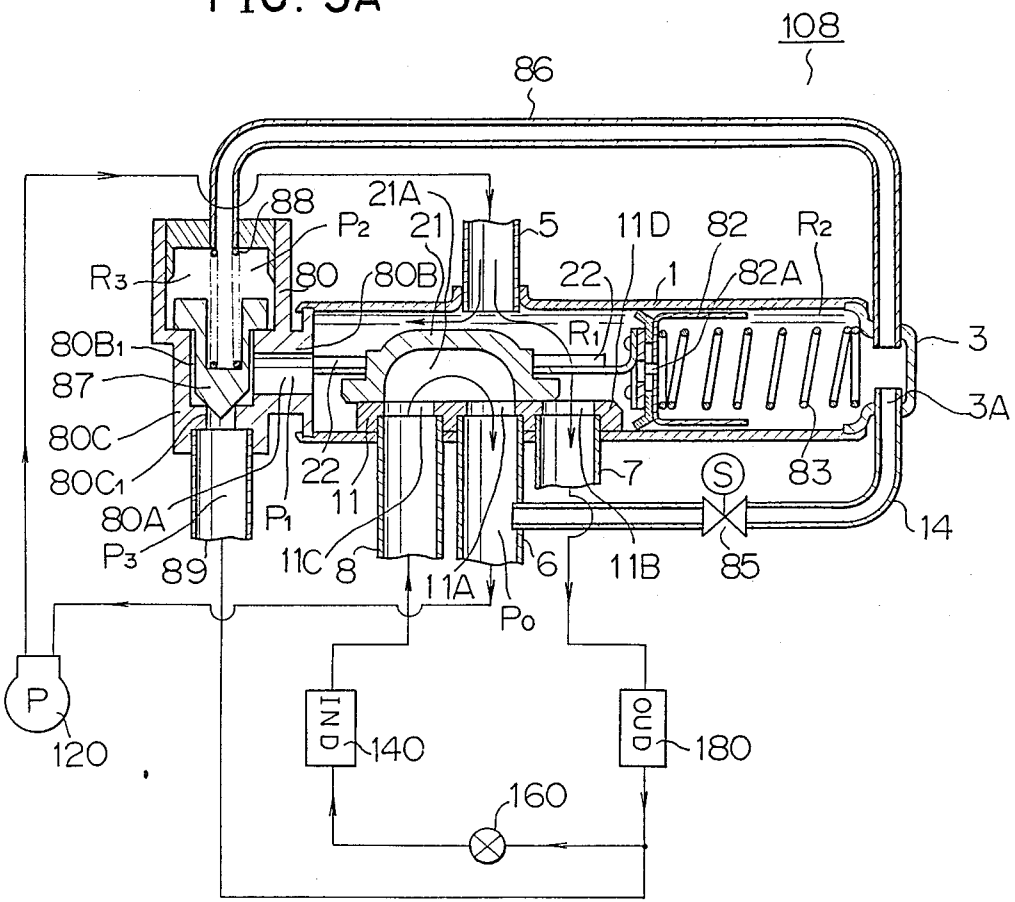
FIGS. 5A, 5B and 5D schematically illustrate a five-way valve according to a fourth preferred embodiment, where the cooling, heating and defrosting modes of the valve are shown.

Referring first to FIG. 5A, the five-way valve 108 includes a valve body 1, a valve member 80 located at one end (left-hand end as viewed in FIG. 5A) of the valve body 1, and a lid 3 located at the other end of the valve body 1.

A piston 82 is mounted for sliding movement in a direction of the longitudinal axis of the valve body 1 between the lid 3 and a valve seat 11 located in the valve body 1. Thus, the piston 82 partitions the inside of the valve body 1 to define a high pressure chamber $R_1$ and a first pressure converting chamber $R_2$. A compression spring 83 is interposed between the piston 82 and the lid 3 to normally urge the piston 82 toward the high pressure chamber $R_1$ (in the leftward direction as viewed in FIG. 5A). The piston 82 has a pressure-equalizing hole 82A for normally communicating the high pressure chamber $R_1$ with the first pressure converting chamber $R_2$ while the lid 3 has formed therein a through hole 3A of a greater diameter than that of the pressure-equalizing hole 82A. A first conduit 14 constituting a pressure venting passage to the inlet side of a compressor 120 is connected to the lid 3. An electromagnetic valve 85 is interposed in the conduit 14.

The defrosting valve member 80 includes a pair of partition walls 80B, 80C formed at positions thereof above and below (as viewed in FIG. 5A) a passage 80A thereof communicating with the high pressure chamber $R_1$ of the valve body 1, and a valve sliding hole $80B_1$ is formed in the partition wall 80B while a valve port $80C_1$ is formed in the partition wall 80C in an opposing relationship to the valve sliding hole $80B_1$. A second pressure converting chamber $R_3$ is defined above the valve sliding hole $80B_1$ of the partition wall 80B of the valve member 80 and is communicated with the first pressure converting chamber $R_2$ by way of a second conduit 86 which interconnects the valve body 80 and the lid 3.

A defrosting valve 87 is mounted for sliding movement in a direction transverse to the communicating passage 80A (in a vertical direction as viewed in FIG. 5A) in the valve sliding hole $80B_1$ of the valve body 80. The defrosting valve 87 is normally urged in a direction to close the valve port $80C_1$ of the partition wall 80C (i.e., in the downward direction in FIG. 5A) by a compression spring 88 interposed between the defrosting valve 87 and the defrosting valve member 80. Connected to the valve port $80C_1$ is a fifth valve port 89 which connects to a duct between an outdoor heat exchanger 180 and an expansion valve 160.

Similarly as in the previous embodiments described hereinabove, a slider valve 21 having a connecting concave 21A formed therein is located on the valve seat 11 and connected to the piston 82 by means of a connecting rod 22. As the slider valve 21 moves along the valve seat 11, it communicates a through hole 11A of the valve seat 11 with one of two other through holes 11B, 11C of the valve seat 11 via the concave 21A.

COOLING MODE OF FOURTH 5-WAY VALVE

Now, the cooling mode of the five-way valve 108 according to the fourth preferred embodiment will be summarized with reference to FIG. 5A.

In the position shown in FIG. 5A, the electromagnetic valve 85 is in a deenergized condition and hence assumes a closed position in which the first conduit 14 is closed. Consequently, the high pressure chamber $R_1$ and the first pressure chamber $R_2$ exhibit an equal pressure due to the communication by way of the pressure-equalizing hole 82A of the piston 82. Accordingly, the piston 82 assumes, under the urging force of the compression spring 83, its left limit position (in FIG. 5A) in which it contacts with the valve seat 11 and the slider valve 21 communicates the through hole 11A connected to the inlet port of the compressor 120 with the through hole 11C connected to the outlet port of an indoor heat exchanger 140 as seen in FIG. 5A. As a result, the refrigerant is circulated in a direction as indicated by arrows indicated in FIG. 5A from the compressor 120 via the first valve port 5, third valve port 7, outdoor heat exchanger 180, expansion valve 160, indoor heat exchanger 140, fourth valve port 8 and second valve port 6 back to the compressor 120.

It is assumed that the pressure applied to a side face of the defrosting valve 87 (i.e., pressure of the high pressure chamber $R_1$) is represented as $P_1$, the pressure to the top face as $P_2$ and the pressure to the lower face as $P_3$, the pressures to the defrosting valve 87 here have a relationship $P_1=P_2=P_3$, and accordingly, the defrosting valve 87 is held by the urging force of the compression spring 88 to a position in which it closes the valve port $80C_1$.

Through the sequence of operations described above, the five-way valve 108 is operated in the cooling mode.

HEATING MODE OF FOURTH 5-WAY VALVE

Then, when the cooling operation of the refrigerating system is stopped and then the electromagnetic valve 85 is energized and also the compressor 120 is started, the inside of the first pressure converting chamber $R_2$ is communicated with the lower pressure of the inlet port (first valve port 6) of the compressor 120 so that the pressure of the first pressure converting chamber $R_2$ starts to flow into the inlet port of the compressor 120 by way of the first conduit 14 while the pressure of the second converting chamber $R_3$ above the top face of the defrosting valve 87 is similarly communicated with the inlet port of the compressor 120.

Under this condition, at the first pressure converting chamber $R_2$, the high temperature and high pressure refrigerant gas escapes to the inlet port via the pressure venting passage (first conduit) 14 while at the same time, the refrigerant gas is supplied from the high pressure chamber $R_1$ via the pressure-equalizing hole 82A of the piston 82 to the first pressure converting chamber $R_2$. As apparent from the conditions described above, because the diameter of the conduit 14 constituting the pressure venting passage is greater than that of the pressure-equalizing hole 82A so that the flow rate of the refrigerant gas supplied to the first pressure converting chamber $R_2$ is higher than the flow rate of the refrigerant gas discharged from the first pressure converting chamber $R_2$, and the pressure of the first pressure converting chamber $R_2$ becomes lower than that of the high pressure chamber $R_1$. Finally, a differential pressure which defeats the urging force of the compression spring 83, appears between the high pressure chamber $R_1$ and the first pressure converting chamber $R_2$. Consequently, the piston 82 and the slider valve 21 connected to the piston 82 start their sliding movement toward the lid 3 (in the rightward direction in FIG. 5A).

Figure 5B:
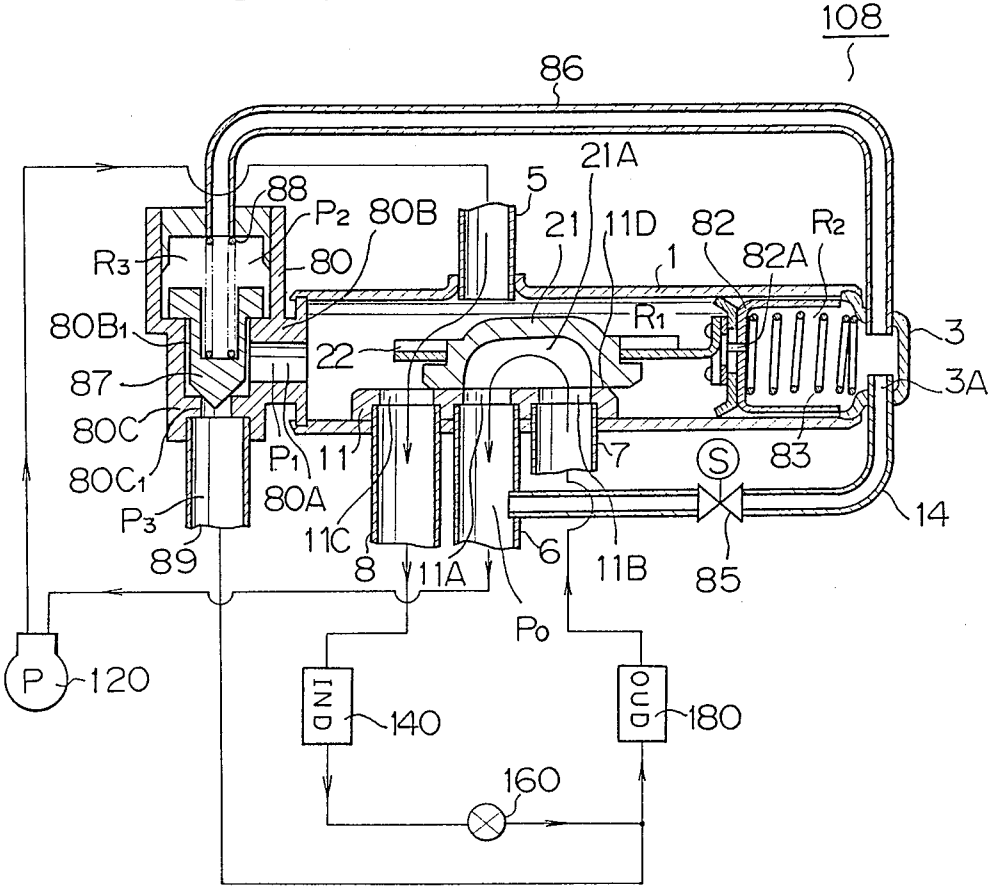

As about one minute has passed after energization of the electromagnetic valve 85, the sliding movement of the piston 82 and the slider valve 21 is completed. In this position, the slider valve 21 communicates the through hole 11A of the valve seat 11 connected to the inlet port of the compressor 120 with the through hole 11B to the inlet port 7 of the outdoor heat exchanger 180 as illustrated in FIG. 5B. Consequently, the refrigerating system now performs a heating operation wherein the high temperature and high pressure refrigerant gas is circulated in a direction indicated by arrows indicated in FIG. 5B from the compressor 120 via the first valve port 5, fourth valve port 8, indoor heat exchanger 140, expansion valve 160, outdoor heat exchanger 180, third valve port 7 and finally, second valve port 6 back to the inlet port of the compressor 120. In this condition, the electromagnetic valve 85 is deenergized to close the pressure venting passage 14.

CONSTRUCTION OF DEFROSTING VALVE

Now, the internal structure and exemplary dimensions of various elements of the defrosting valve 87 employed in this five-way valve 108 will be described with reference to FIG. 5C.

If it is assumed that the inner diameter $\phi Ad$ of the valve port $80C_1$ is $\phi Ad=\phi 0.6$ cm, the inner diameter $\phi AD_1$ of a lower portion of the valve sliding hole $80B_1$ for the defrosting valve 87 is $\phi AD_1=\phi 0.9$ cm and the inner diameter $\phi AD_2$ of an upper portion of the valve sliding hole $80B_1$ for the defrosting valve 87 is $\phi AD_2=\phi 1.67$ cm, then the effective areas of the individual portions are given respectively as $$Ad(S)=(0.6/2)^2\pi=0.283\ \text{cm}^2$$

$$AD_1(S)=(0.9/2)^2\pi=0.636\ \text{cm}^2$$

$$AD_2(S)=(1.67/2)^2\pi=2.19\ \text{cm}^2$$

Meanwhile, if it is assumed that the urging force SP of the spring 88 when the valve 87 is in its closed position is SP=1.9 kg and the reactive force $SP_R$ of the spring 88 when the valve 87 is in its fully open position is $SP_R=2.5$ kg and if the force of the defrosting valve 87 in the opening direction (upward direction as viewed in FIG. 5C) is represented as $F_1$ and the force in the closing direction (downward direction as viewed in FIG. 5C) as $F_2$, then $F_1$, $F_2$ are given as follows:

$$F_1=AD_1(S)\times(P_1-P_2) \quad (1)$$

$$F_2=Ad(S)\times(P_1-P_3)+SP \quad (2)$$

Here, it is assumed that $P_1=9.5$ kgf/cm$^2$, $P_2=6$ kgf/cm$^2$, and $P_3=9.5$ kgf/cm$^2$, and if these are substituted in the equations (1), (2) above, then $$F_1=0.636\times(9.5-6)=2.22\ \text{kg} \quad (3)$$

$$F_2=0.283\times(9.5-9.5)+2.4=2.4\ \text{kg} \quad (4)$$

Here, $F_1(3)<F_2(4)$, and accordingly the defrosting valve 87 remains closed.

Accordingly, when the pressure difference ($\Delta P=9.5-6$ kgf/cm$^2$), the defrosting valve 87 maintains its closed position.

DEFROSTING MODE OF FOURTH 5-WAY VALVE

Now, operation of the five-way valve 108 of the present embodiment in the defrosting mode will be described using mathematical relations of pressure and with reference to FIG. 5D.

At first, in the heating mode illustrated in FIG. 5B, $$F_1=AD_1(S)\times(P_1-P_2) \quad (5)$$

$$F_2=Ad(S)\times(P_1-P_3)+SP \quad (6)$$

Here, if it is assumed that $P_1=11.5$ kgf/cm$^2$, $P_2=5$ kgf/cm$^2$, and $P_3=5$ kgf/cm$^2$, then $$F_1=0.636\times(11.5-5)=4.13\ \text{kg} \quad (7)$$

$$F_2=0.283\times(11.5-5)+2.4=4.24\ \text{kg} \quad (8)$$

Therefore, $F_1(7)<F_2(8)$ here, and accordingly the defrosting valve 87 remains closed.

Accordingly, if the electromagnetic valve 85 is deenergized and thus closed before the pressure difference $\Delta P=P_1-P_2$ becomes equal to 6.5 kgf/cm$^2$ after completion of switching the five-way valve 108 to its heating mode as seen in FIG. 5B, the defrosting valve 87 will maintain its closed position.

If defrosting is required during heating mode of the five-way valve 108 as seen in FIG. 5B, the electromagnetic valve 87 is brought to its open position, and now $$F_1=AD_1(S)\times(P_1-P_2) \quad (9)$$

$$F_2=Ad(S)\times(P_1-P_2)+SP \quad (10)$$

Here, if it is assumed that $P_1=15$ kgf/cm$^2$, $P_2=5$ kgf/cm$^2$, and $P_3=5$ kgf/cm$^2$, then $$F_1=0.636\times(15-5)=6.36 \text{ kg} \quad (11)$$

$$F_2=0.283\times(15-5)+2.4=5.23 \text{ kg} \quad (12)$$

Consequently, $F_1(11)>F_2(12)$ now, and accordingly the defrosting valve 87 is moved to its open position (upward direction).

Figure 5D:
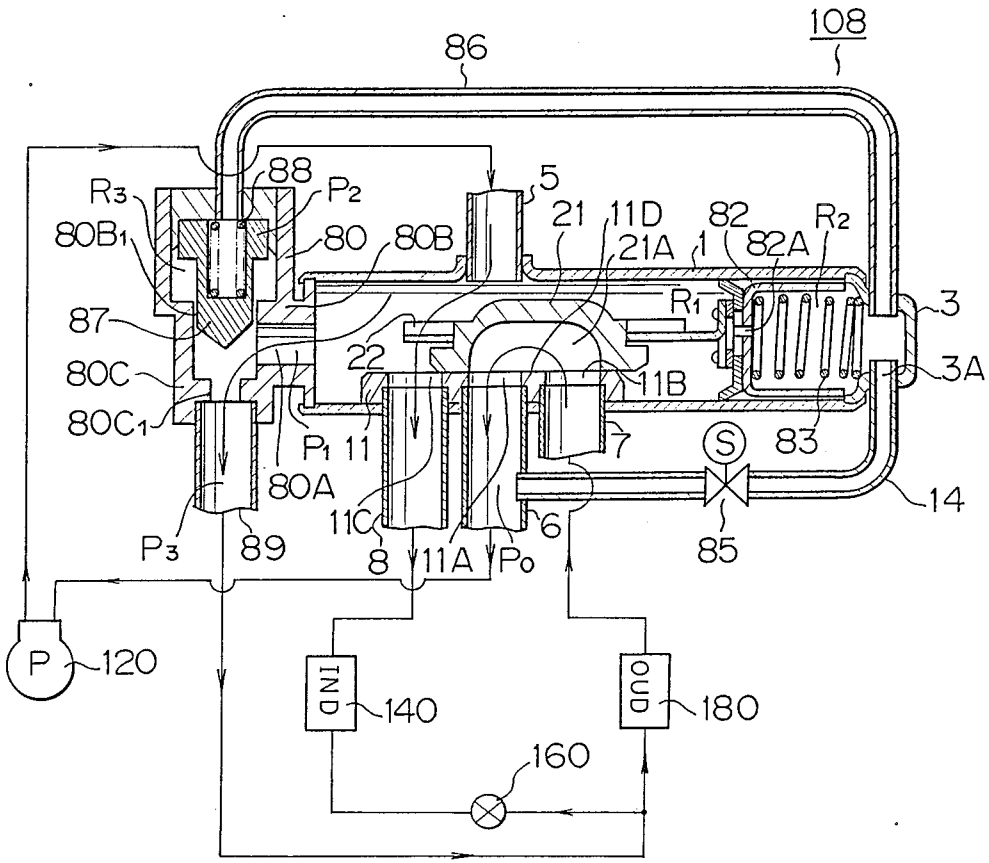

Accordingly, the high temperature and high pressure refrigerant gas will be supplied via the defrosting valve 87 and the fifth valve port 89 to the outdoor heat exchanger 180 thereby to defrost the outdoor heat exchanger 180 (see FIG. 5D).

Then, if during the defrosting mode the pressure difference $\Delta P=P_1-P_2$ is reduced to 2 kgf/cm$^2$, then $$F_1=AD_2(S)\times(P_1-P_2) \quad (13)$$

$$F_2=Ad(S)\times(P_1-P_3)+SP \quad (14)$$

Here, if it is assumed that $P_1=9$ kgf/cm$^2$, $P_2=7$ kgf/cm$^2$, and $P_3=7$ kgf/cm$^2$, then $$F_1=2.19\times(9-7)=4.38 \text{ kg} \quad (15)$$

$$F_2=0.283\times(9-7)+3=3.57 \text{ kg} \quad (16)$$

Consequently, $F_1(15)>F_2(16)$ here, and accordingly the defrosting valve 87 will maintain its open position.

As can be easily recognized from the mathematical relations of pressure described in detail above, when defrosting operation is to be performed, if the electromagnetic valve 85 is turned and held on so as to keep its open position, then the defrosting valve 87 will be brought to and thereafter held to its open position as seen in FIG. 5D. After a predetermined period of time has passed, the electromagnetic valve 85 may be deenergized and thus closed to stop the defrosting operation. As a result, the normal heating condition as seen in FIG. 5B is restored.

As described in detail above, the five-way valve 108 of the present embodiment is characterized in that it comprises a cylindrical valve body, a piston for partitioning the inside of the cylindrical valve body to define a high pressure chamber and a pressure converting chamber, a connecting hole to the outlet port of a compressor being provided for the high pressure chamber, two further connecting holes to conduits for an outdoor heat exchanger and an indoor heat exchanger being provided for the high pressure chamber at opposite positions with respect to the connecting hole to the outlet port of the compressor, a switching valve seat extending over a range of the connecting hole to the inlet port of the compressor and the connecting holes to the conduits for the outdoor and indoor heat exchangers, a slider valve mounted for sliding movement along the switching valve seat and connected to the piston, the piston having a pressure-equalizing hole formed therein for communicating the high pressure chamber with the pressure converting chamber, a spring for urging the piston toward the high pressure chamber, a pressure venting passage provided for the pressure converting chamber so as to communicate with the inlet port side of the compressor and having a greater diameter than the pressure-equalizing hole of the piston, an electromagnetic valve interposed in the pressure venting passage, a valve member located on the other side of the high pressure chamber and defining therein a second pressure converting chamber which communicates with the first-mentioned pressure converting chamber, a defrosting valve located in the second pressure converting chamber, and a spring for urging the defrosting valve toward the high pressure side, the defrosting valve being movable to open or close a valve port between the high pressure chamber and a passage to an outdoor heat exchanger, whereby, when the electromagnetic valve is opened during heating operation, the defrosting valve opens the valve port to the outdoor heat exchanger. Accordingly, while the five-way valve continues its heating operation, defrosting of the outdoor heat exchanger can be simultaneously performed. Since in this instance the defrosting valve can be operated using the electromagnetic valve for switching cooling/heating modes, the five-way valve is advantageous in that it can be operated easily and the construction thereof can be simplified.

DESCRIPTION OF FIFTH 5-WAY VALVE

In summary, the first to fourth five-way valves 102 to 108 described hereinabove have a common feature that both the slider valve 21 and the defrosting valve 24, 48 or 87 can be actuated by utilizing a difference in the refrigerant gas pressures which is produced by the pressure of high temperature and high pressure refrigerant gas. In other words, in order to operate those valves, a pressure difference is produced by the energization/deenergization of the electromagnetic valve in cooperation with a sucking force of the compressor 120 at the inlet port thereof.

In contrast with the above-described five-way valves a five-way valve 109 according to a fifth preferred embodiment of the present invention described below has another feature that it is operable by employing two different mechanical driving forces which can be derived from an electromagnetic actuator having two operating modes. However, this five-way valve 109 still has a characteristic common to the five-way valves of the preceding embodiments that it can be operated in the defrosting mode while continuing its heating operation.

CONSTRUCTION OF FIFTH 5-WAY VALVE

Now, a construction of the five-way valve 109 of the present embodiment will be described with reference to FIGS. 6A and 6B.

Figure 6A:
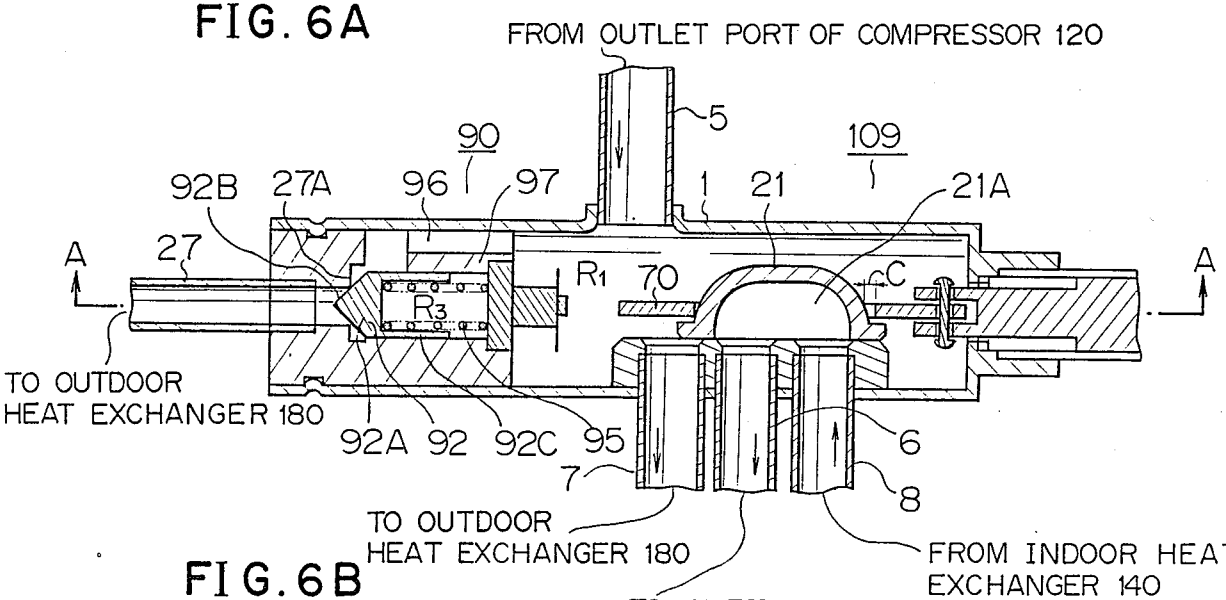
FIGS. 6A to 6E schematically show a five-way valve 109 according to a fifth preferred embodiment, where the cooling, heating and defrosting modes of the valve are illustrated.
Figure 6B:
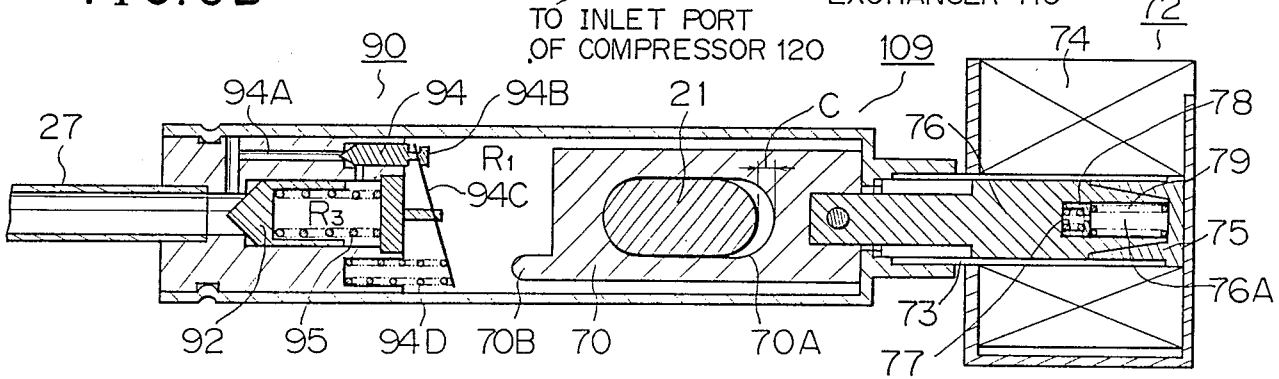

FIG. 6A is a longitudinal sectional view of the fifth five-way valve 109 with an actuator thereof omitted, and FIG. 6B is a cross-sectional view taken along line of the longitudinal axis A-A of the five-way valve 109 of FIG. 6A.

Referring first to FIG. 6A, the five-way valve 109 includes a cylinder-shaped valve body 1. As apparently seen from FIG. 6A, the valve body 1 has four valve ports 5, 6, 7 and 8 connected thereto in perpendicular directions to the longitudinal axis thereof in a similar disposition to those of the preceding embodiments. Also, a slider valve 21 is mounted similarly for sliding movement across the ports 6 to 8. Accordingly, description of the functions and operations of those elements will be omitted herein.

DEFROSTING VALVE

A defrosting valve 90 is located at a left-hand end of the valve body 1 as viewed in FIG. 6A. The defrosting valve 90 is mainly composed of a main valve 92 and a pilot valve 94. In FIG. 6A, the five-way valve 109 is shown in the cooling mode as described below in which the defrosting valve 90 is in its closed position (at a leftwardly shifted position). In particular, in the closed position of the defrosting valve 90, a conical surface 92B of a conical body 92A of the main valve 92 is held in contact with a valve seat 27A formed on one end portion of an outlet port 27 which connects to an outdoor heat exchanger 180. The main valve 92 has a cylindrical body 92C in which a compression spring 95 for normally urging the main valve 92 toward the valve seat 27A is installed.

High temperature and high pressure refrigerant gas is similarly supplied from the outlet port of the compressor 120 into the valve body 1 via the first valve port 5, and a passage 96 is formed in the valve body 1 as shown in FIG. 6A, so as to introduce the high temperature, and high pressure refrigerant gas from the valve body 1 into the inside of the cylindrical body 92C of the main valve 92 of the defrosting valve 90. Thus, the high temperature and high pressure refrigerant gas introduced in this manner passes through the passage 96 to the conical surface 92B of the main valve 92 and then is filled into a spacing within the cylindrical body 92C of the main valve 92 via a gap formed between an outer surface of the cylindrical body 92C and an adjacent wall 97. Thus, the main valve 90 maintains its closed position due to relative effects between a pressure of the high pressure refrigerant gas filled in the cylindrical body 92C of the main valve 92 and an urging force of the compression spring 95.

PILOT VALVE

Referring now to FIG. 6B, a construction of the pilot valve 94 will be described.

The pilot valve 94 is operated prior to operation of the main valve 92, because the main valve 92 cannot be directly operated by a sliding member 70 for slidably moving the slider valve 21 described hereinbelow. In other words, a greater sliding force is required to directly slide the main valve 92.

As illustrated in FIG. 6B, the pilot valve 94 is interposed in a pilot passage 94A and extends in a parallel relationship to the main valve 92 and also to the longitudinal axis of the valve body 1. The pilot passage 94A has a function to accommodate the pilot valve 94 therein and another function to supply therethrough the high pressure refrigerant gas from the slider valve 21 side to the defrosting valve port (27) side. The pilot valve 94 is connected at a head portion 94B thereof to one end of a leaf spring 94C. The leaf spring 94C is supported at a substantially central portion thereof for pivotal motion on the body of the defrosting valve 90. The other end of the leaf spring 94C is contacted and urged by a compression spring 94D in a direction to close the pilot valve 94 (in the leftward direction as viewed in FIG. 6B).

The sliding member 70 has an elongated hole **70*a* formed therein as shown in FIG. 6B and is held in normal engagement at the elongated hole 70A thereof with an upper portion of the slider valve-21. In the position as seen in FIG. 6B, a clearance "C" is formed between an edge of the elongated hole 70A of the sliding member 70 and an opposing face of the slider valve 21**.

ELECTROMAGNETIC ACTUATOR

A description will now be made of a construction of an electromagnetic actuator 72 for slidably moving the slider valve 21 by way of the sliding member 70 with reference to FIG. 6B.

The actuator 72 is located at the other end of the valve body 1 of the five-way valve 109 remote from the defrosting valve 90. The actuator 72 includes a plunger tube 73, a solenoid coil 74, a fixed core 75, a plunger 76, a first spring 77, a spring retainer 78 and a second spring 79.

The spring retainer 78 is held between the first spring 77 accommodated in a spring chamber 76A within the plunger 76 and the second spring 79 having a greater spring force than the first spring 77. In the normal position, the urging forces of the first and second springs 77, 79 are balanced with each other. It is to be noted, however, that in the position shown in FIG. 6B, the balanced condition is not established because the solenoid coil 74 is energized so that the plunger 76 is attracted to the fixed core 75 of the actuator 72. When the plunger 76 is not attracted to the fixed core 75, a predetermined gap is left between a lower end of the spring retainer 78 and the bottom surface of the spring chamber 76A as hereinafter described.

The other end of the plunger 76 is mechanically connected to the slider member 70 so that the sliding movement of the plunger 76 may be transported, as a sliding force, to the slider valve 21.

The electromagnetic actuator 72 with the above-described arrangement provides two different sliding lengths in accordance with strengths of the exciting current flow through the solenoid coil 74 as hereinafter described. This allows switching control of the five-way valve 109 among the cooling, heating and defrosting modes.

COOLING MODE OF FIFTH 5-WAY VALVE

The cooling mode of the five-way valve 109 according to the present embodiment will now be described with reference to FIGS. 6A and 6B.

At first, it is understood that the electromagnetic actuator 72 was once driven with first exciting current of a high level in order that the plunger 76 is held attracted to the fixed core 75 of the actuator 72 against the urging forces of the first and second springs 77, 79 (as viewed in FIGS. 6A and 6B). Thereafter, supply of this first exciting current to the coil 74 is stopped. However, the sliding member 70 is held in its right limit position (i.e., the cooling position) within the valve body by means of the high pressure applied to the slider valve 21. In this position of the sliding member 70, the communication between the inlet port of the compressor 120 and the outlet port of an indoor heat exchanger 140 is established by the slider valve 21. Under the condition, a left end, or tip 70B (as viewed in FIG. 6B) of the sliding member 70 is positioned apart from the leaf spring 94C of the pilot valve 94. As a result, the pilot valve 94 remains in its closed position where no defrosting mode of the five-way valve 109 is effected.

The remaining construction of the five-way valve 109 and the circulation of the high pressure refrigerant gas in the five-way valve 109 are similar to those of the previous embodiments, and no further description will be made herein.

TRANSITION BETWEEN COOLING MODE AND HEATING MODE

Figure 6C:
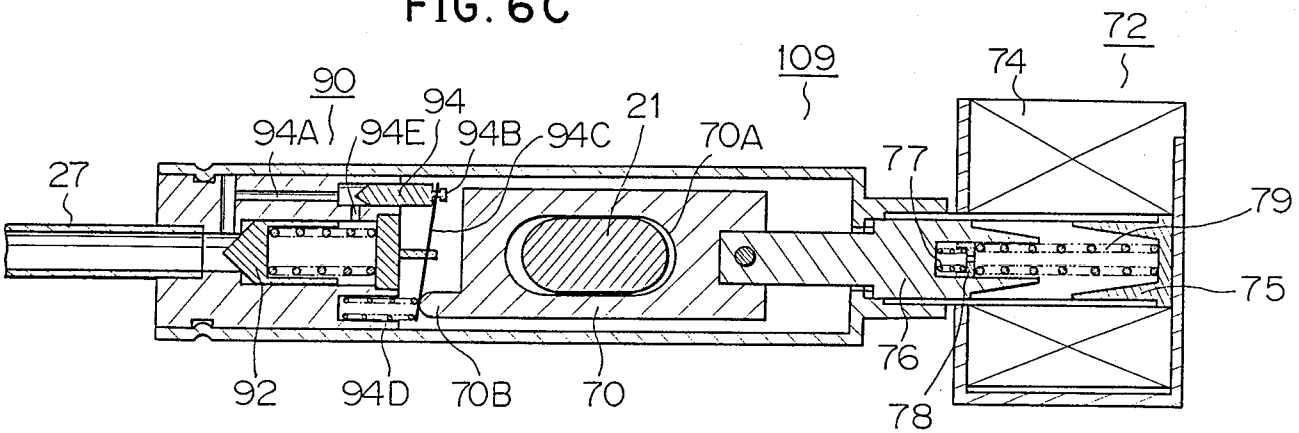

Now, a transition mode during switching from the cooling mode to the heating mode will be described with reference to FIG. 6C.

At first, the compressor 120 is turned off and thus no refrigerant gas is supplied to the chamber within the valve body 1. Consequently, the plunger 76 is allowed to be slid in the leftward direction as viewed in FIG. 6C by the urging forces of the first and second springs 77, 79. As a result of the leftward movement of the plunger 76, the sliding member 70 connected to the plunger 76 is slidably moved toward the leftmost position as viewed in FIG. 6C along the longitudinal axis of the five-way valve 109, and in turn the slider valve 21 is also moved in the same direction through the engagement thereof with the elongated hole 70A of the sliding member 70. As a result, the tip 70B of the sliding member 70 is brought into contact with and pushes the leaf spring 94C of the pilot valve 94 as seen in FIG. 6C so that the pilot valve 94 is slightly opened for an instant by the leaf spring 94C. However, since the compressor 120 remains stopped, no defrosting operation is performed even if the pilot valve passage 94A is opened. Thereafter, the second exciting current is flown through the electromagnetic coil 74 to slide only the sliding member 70 by the clearance C, and the compressor 120 is again energized. This second exciting current is lower than the first exciting current.

HEATING MODE OF FIFTH 5-WAY VALVE

Figure 6D:
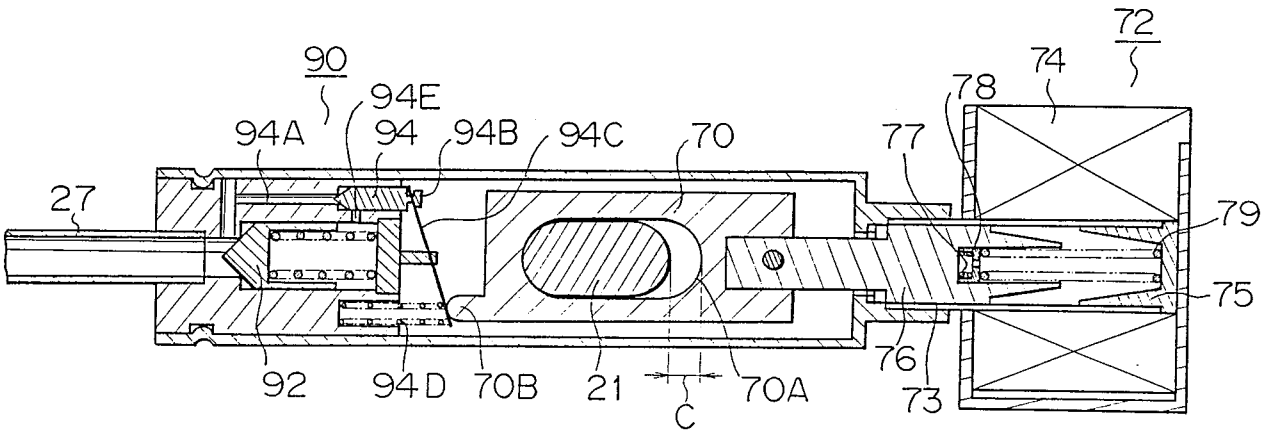

As described just above, after passing the transition mode, while the second exciting current is supplied to the solenoid coil 74, the compressor 120 is turned on, and accordingly the five-way valve 109 is now in the heating mode as illustrated in FIG. 6D. In such a position of the slider valve 21 as shown in FIG. 6D, the second valve port 6 for the compressor 120 is communicated with the third valve port 7 for the outdoor heat exchanger 180. As apparently seen in FIG. 6D, in the heating mode, the sliding member 70 is stopped at a position after its movement by a distance equal to the aforementioned clearance "C" back in the rightward direction as viewed in FIG. 6D. Meanwhile, during the heating mode as shown in FIG. 6D, the first spring 77 of the electromagnetic actuator 72 is held in a compressed condition.

DEFROSTING MODE OF FIFTH 5-WAY VALVE

Now, operation of switching from the heating mode shown in FIG. 6D to the defrosting mode will be described with reference to FIGS. 6C to 6E.

To change the five-way valve 109 into the defrosting mode, the second exciting current is simply stopped to energize the solenoid coil 74 of the electromagnetic actuator 72. Consequently, the sliding member 70 is moved in the leftward direction as viewed in FIG. 6C by a distance equal to the clearance "C" of FIG. 6D by means of the second spring 77 so that the position of the five-way valve 109 shown in FIG. 6C is reached. Consequently, while the slider valve 21 remains stopped at its heating mode position, the pilot valve 94 is brought to its fully open position as the tip 70B of the sliding member 70 pushes to pivot the leaf spring 94 in the clockwise direction in FIG. 6C. As a result, a part of the high pressure refrigerant gas within the main valve 92 is introduced, via a through hole 94E, into the pilot passage 94A and then to the defrosting valve port 27 and finally to a portion between the outdoor heat exchanger 180 and an expansion valve 160.

Figure 6E:
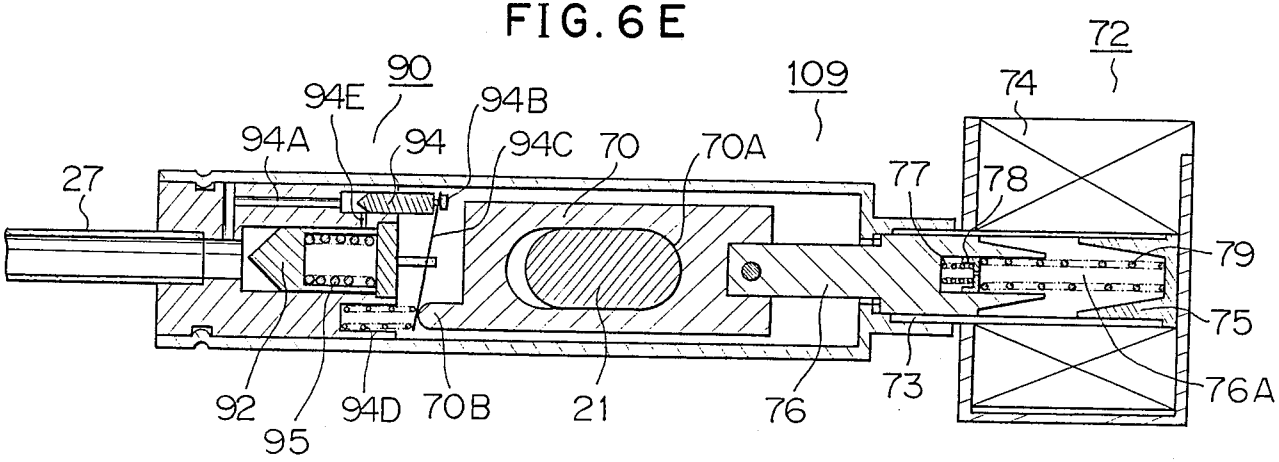

As a result, the main valve 92 is brought to its open position (i.e., moved in the rightward direction as viewed in FIG. 6C) as shown in FIG. 6E by the pressure of the high pressure refrigerant gas which is introduced from the compressor 120 to and acts upon the conical surface 92B of the main valve 92 as described hereinabove with reference to FIG. 6A.

Then, when the desired defrosting operation is completed, the solenoid coil 74 is energized again with the second exciting current. Consequently, the plunger 76 is attracted toward the core 75 of the actuator 72 until the position of the sliding member 70 in which the tip 70B thereof does not press against the leaf spring 94C is reached.

POWER SUPPLY CONTROLLER FOR ACTUATOR

Figure 7:
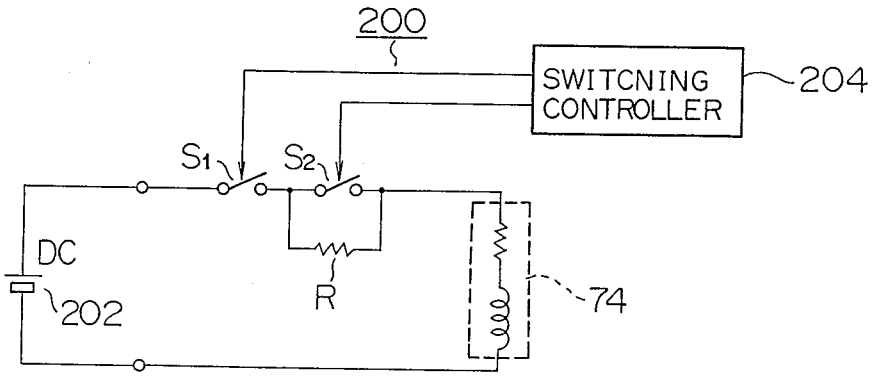
FIG. 7 is a schematic block diagram illustrating a power supply controller for energizing an electromagnetic actuator of the five-way valve of FIG. 6A.

Now, a power supply controller 200 for energizing the electromagnetic actuator 72 of the five-way valve 109 of the present embodiment will be described with reference to FIG. 7.

The power supply controller 200 includes a DC power source 202 connected to the solenoid coil 74 of the actuator 72 by way of a series circuit of a first switch $S_1$ and a second switch $S_2$. A resistor R is connected in parallel to the second switch $S_2$. A switching controller 204 for controlling opening and closing operation of the first and second switches $S_1$, $S_2$ is connected to the switches $S_1$, $S_2$.

At first, if the first and second switches $S_1$, $S_2$ are both opened under the control of the switching controller 204, no exciting current will flow through the solenoid coil 74. Accordingly, the five-way valve 109 is brought into the defrosting mode as shown in FIG. 6E.

Then, when only the first switch $S_1$ is closed, the exciting current from the dc power source 202 flows through the solenoid coil 74 via the resistor R. This exciting current corresponds to the second exciting current described above, which presents a lower level than the first exciting current due to a voltage drop across the resistor R. Thus, the five-way valve 109 operates in the heating mode as shown in FIG. 6D.

Then, when the second switch $S_2$ is closed in addition to the first switch $S_1$, the resistor R is shortcircuited so that the higher first exciting current will flow through the solenoid coil 74. Thus, the five-way valve 109 operates in the cooling mode as shown in FIGS. 6A and 6B.

MODIFICATIONS

While the invention has been described in terms of certain preferred embodiments and exemplified with respect thereto, those skilled in the art will readily appreciate that various modifications, changes, omissions and substitutions may be made without departing from the spirit of the invention.

In FIGS. 4A and 4B, although two reservoirs 62 and 63 were employed, the former being heat-coupled to the cooler 64, a single reservoir may be employed.

In the preferred embodiments, the five-way valves were employed as the cylindrical valve body. However, the shape of the valve body is not limited to a cylinder, but may be a hollow body.

What is claimed is:

1. A five-way valve operable in a refrigerant flow reversing system comprising:

a hollow valve body;

piston means slidably provided within said hollow valve body to divide the same into a high pressure chamber and a first pressure converting chamber, and having a pressure equalizer for equalizing pressures between said high pressure chamber and said first pressure converting chamber, said high pressure chamber including a first valve port communicating with an outlet of a compressor to receive a high temperature and high pressure refrigerant, a second valve port communicating with an inlet of said compressor, a third valve port communicating with an outdoor heat exchanger, and a fourth valve port communicating with an indoor heat exchanger;

slider valve means slidably provided within said high pressure chamber and mechanically connected to said piston means, for selectively communicating said second valve port for said inlet of the compressor with one of said third and fourth valve ports, whereby said indoor and outdoor heat exchangers are selectively changed for selectively heating and cooling ambient atmosphere thereof;

defrosting valve means provided within said hollow valve body to define a second pressure converting chamber, said second pressure converting chamber including a fifth valve port communicating with said outdoor heat exchanger to pass said high temperature and high pressure refrigerant induced in said high pressure chamber to said outdoor heat exchanger, said defrosting valve means having a passage to receive a high pressure of said refrigerant induced in said high pressure chamber;

a first connecting member for connecting said first pressure converting chamber to said second pressure converting chamber so as to equalize pressures in said first and second pressure converting chambers with each other;

a second connecting member for connecting said first pressure converting chamber to said second valve port for said inlet of the compressor; and, electromagnetic valve means for selectively opening and closing a passage of said second connecting member so as to communicate said first and second pressure converting chambers with said second valve port in cooperation with said second connecting member, whereby when said electromagnetic valve means opens the passage of said second connecting member to produce a lower pressure than the pressure in said high pressure chamber at least in said second pressure converting chamber, said defrosting valve means is actuated to pass said high temperature and high pressure refrigerant in said high pressure chamber to said outdoor heat exchanger via said fifth valve port while said indoor heat exchanger receives the high temperature and high pressure refrigerant from said high pressure chamber to heat the ambient atmosphere thereof.

2. A five-way valve as claimed in claim 1, wherein said hollow valve body is a cylindrical valve body having a longitudinal axis, along which said high pressure, first and second pressure converting chambers are aligned in such a manner that said high pressure chamber is located at a center of said cylindrical valve body.

3. A five-way valve as claimed in claim 1, wherein said piston means includes a first compression spring for urging said piston means toward said high pressure chamber when both said high pressure chamber and said first pressure converting chamber are under substantially equal pressure by means of said pressure equalizer.

4. A five-way valve as claimed in claim 1, wherein said defrosting valve means includes a second compression spring for urging said defrosting valve means toward said high pressure chamber to close a passage of said fifth valve port when both said high pressure chamber and said second pressure converting chamber are under substantially equal pressure.

5. A five-way valve as claimed in claim 1, wherein said electromagnetic valve means includes:

an electromagnetic valve for generating electromagnetic force;

a plunger magnetically coupled to said electromagnetic coil and capable of sliding under the influence of the electromagnetic force;

a needle valve formed on the plunger; and a third compression spring for urging said needle valve to close a passage of said second connecting member whereby the pressure in the high pressure chamber is substantially equal to the pressures of the first and second pressure converting chambers by means of the pressure equalizer and the first connecting member.

6. A five-way valve as claimed in claim 1, wherein said pressure equalizer is a through hole having a first diameter; and said passage of the second connecting member has a second diameter greater than the first diameter of said through hole, whereby an amount of the high temperature and high pressure refrigerant supplied from the high pressure chamber to the first pressure converting chamber via said through hole is smaller than that exhausted from the first pressure converting chamber to the second valve port via said passage of the second connecting member.

7. A five-way valve operable in a refrigerant flow reversing system comprising:

a hollow valve body;

piston means slidably provided within said hollow valve body to divide the same a high pressure chamber and a first pressure converting chamber, and having a first pressure equalizer for equalizing a pressure between said high pressure chamber and said first pressure converting chamber, said high pressure chamber including a first valve port communicating with an outlet of a compressor to receive a high temperature and high pressure refrigerant, a second valve port communicating with an inlet of said compressor, a third valve port communicating with an outdoor heat exchanger, a fourth valve port communicating with an indoor heat exchanger, and a fifth valve port communicating with said outdoor heat exchanger;

slider valve means slidably provided within said high pressure chamber and mechanically connected to said piston means, for selectively communicating said second valve port for said inlet of the compressor with one of said third and fourth valve ports, whereby said indoor and outdoor heat exchangers are selectively changed for selectively heating and cooling ambient atmosphere thereof;

defrosting valve means provided within said hollow valve body to define a second pressure converting chamber, and including a piston member having a second pressure equalizer for communicating said second pressure converting chamber with said high pressure chamber, and a defrosting valve body slidably connected to said piston member for opening and closing a passage of said fifth valve port;

separator means provided within said first pressure converting chamber to define a third pressure converting chamber, said third pressure converting chamber including an auxiliary valve member actuatable in response to the sliding operation of said piston means, and a valve hole for communicating said first pressure converting chamber with said third pressure converting chamber in response to operation of said auxiliary valve;

a first connecting member for connecting said second pressure converting chamber to said third pressure converting chamber so as to equalize pressures in said second and third pressure converting chambers with each other;

a second connecting member for connecting said first pressure converting chamber to said second valve port for said inlet of the compressor; and, electromagnetic valve means interposed in said second connecting member, for selectively opening and closing a passage of said second connecting member so as to communicate said first, second and third pressure converting chambers with said second valve port in cooperation with said auxiliary valve member and said piston means, whereby when said electromagnetic valve means opens the passage of said second connecting member to produce a lower pressure than the pressure in said high pressure chamber at least in said second pressure converting chamber, said defrosting valve body is slid by said piston member to pass said high temperature and high pressure refrigerant in said high pressure chamber to said outdoor heat exchanger via said fifth valve port while said indoor heat exchanger receives the high temperature and high pressure refrigerant from said high pressure chamber to heat the ambient atmosphere thereof.

8. A five-way valve as claimed in claim 7, wherein said hollow valve body is a cylindrical valve body having a longitudinal axis, along which said high pressure, first, second and third pressure converting chambers are aligned in such a manner that said high pressure chamber is located inbetween said first and second pressure converting chambers.

9. A five-way valve as claimed in claim 7, wherein said piston means includes a first compression spring for urging said piston means toward said high pressure chamber when both said high pressure chamber and said first pressure converting chamber are under substantially equal pressure by means of said pressure equalizer.

10. A five-way valve as claimed in claim 7, wherein said defrosting valve means includes a second compression spring for urging said piston member toward said high pressure chamber to close said passage of the fifth valve port by sliding said defrosting valve body when said high pressure chamber and said second pressure converting chamber are under substantially equal pressure.

11. A five-way valve as claimed in claim 9, further comprising:

a wall provided within said first pressure converting chamber for receiving said first compression spring; and a valve opening rod slidably provided in said wall for urging said auxiliary valve member to be opened in response to the sliding operation of said piston means.

12. A five-way valve as claimed in claim 11, further comprising:

a pressure passage formed on said wall and having a first diameter, said first diameter being greater than a second diameter of said pressure equalizer, whereby an amount of the high temperature and high pressure refrigerant supplied from the high pressure chamber to the first pressure converting chamber via said pressure equalizer is smaller than that exhausted from the first pressure converting chamber to the second valve port via said pressure passage of the wall.

13. A five-way valve as claimed in claim 12, wherein said auxiliary valve member is a ball bearing, and a fourth compression spring is employed to urge said ball bearing against said valve opening rod.

14. A five-way valve operable in a non-azeotropic refrigerant flow reversing system comprising:

a hollow valve body;

piston means slidably provided within said hollow body to divide the same into a high pressure chamber and a pressure converting chamber, having a bleed hole and a bleed valve for opening and closing said bleed hole, said bleed valve having a pressure equalizer for communicating said high pressure chamber with said pressure converting chamber, and said high pressure chamber including a first valve port communicating with an outlet of a compressor to receive a high temperature and high pressure non-azeotropic refrigerant, a second valve port communicating with an inlet of said compressor, a third valve port communicating with an outdoor heat exchanger, and a fourth valve port communicating with an indoor heat exchanger;

slider valve means slidably provided within said high pressure chamber and mechanically connected to said piston means, for selectively communicating said second valve port for said inlet of the compressor with one of said third and fourth valve ports, whereby said indoor and outdoor heat exchangers are selectively changed for selectively heating and cooling ambient atmosphere thereof;

a cooling member interposed between said second valve port and said inlet of the compressor;

a reservoir member heat-coupled with said cooling member for storing said non-azeotropic refrigerant;

expansion valve means connected between said indoor heat exchanger and said outdoor heat exchanger, and also to said reservoir member for passing said non-azeotropic refrigerant therethrough;

a pressure passage member connected to said pressure converting chamber;

a connecting member for connecting said pressure converting chamber to said second valve port for the inlet of the compressor via said pressure passage member;

electromagnetic valve means for selectively opening and closing a passage of said connecting member so as to communicate said pressure converting chamber with said valve port in cooperation with said second connecting member; and defrosting controlling means for electronically controlling said electromagnetic valve means and said expansion valve means, whereby when said electromagnetic valve means opens the passage of said connecting member to pass the non-azeotropic refrigerant from the high pressure chamber to said cooling member via said connecting member, said non-azeotropic refrigerant heated in said reservoir member by the heat transfer of said cooling member is forcibly flown into the non-azeotropic refrigerant supplied from the indoor heat exchanger via said expansion valve means while fully opening said expansion valve means under the control of said defrosting controlling means.

15. A five-way valve as claimed in claim 14, wherein said piston means includes a first compression spring for urging said piston means toward said high pressure chamber when both said high pressure chamber and said pressure converting chamber are under substantially equal pressure by means of said pressure equalizer, said bleed hole, and said pressure passage member.

16. A five-way valve as claimed in claim 14, wherein said reservoir member is constructed of a first reservoir having a first capacity and heat-coupled with said cooling member, and of a second reservoir having a second capacity smaller than said first capacity, and a separator is connected in series with said first and second reservoirs.

17. A five-way valve as claimed in claim 14, wherein said pressure equalizer of the bleed valve has a first diameter, said bleed hole of the piston means has a second diameter, and said pressure passage member has a third diameter, said first diameter of the pressure equalizer being smaller than said second and third diameters, whereby an amount of the high temperature and high pressure refrigerant supplied from the high pressure chamber to the pressure converting chamber via said pressure equalizer and bleed hole is smaller than that exhausted from the pressure converting chamber to the second valve port via said pressure passage member and connecting member.

18. A five-way valve operable in a refrigerant flow reversing system comprising:

a hollow valve body;

piston means slidably provided within said hollow valve body to divide the same into a high pressure chamber and a first pressure converting chamber, and having a pressure equalizer for equalizing a pressure between said high pressure chamber and said first pressure converting chamber, said high pressure chamber including a first valve port communicating with an outlet of a compressor to receive a high temperature and high pressure refrigerant, a second valve port communicating with an inlet of said compressor, a third valve port communicating with an outdoor heat exchanger, and a fourth valve port communicating with an indoor heat exchanger;

slider valve mean slidably provided within said high pressure chamber and mechanically connected to said piston means, for selectively communicating said second valve port for said inlet of the compressor with one of said third and fourth valve ports, whereby said indoor and outdoor heat exchangers are selectively changed for selectively heating and cooling ambient atmosphere thereof;

defrosting valve means including a defrosting valve member, a pressure passage, and a fifth valve port, and connected to said high pressure chamber via said pressure passage, said defrosting valve member defining a second pressure converting chamber within said defrosting valve means, said second pressure converting chamber communicating with said high pressure chamber via said pressure passage to receive the high temperature and high pressure refrigerant from the high pressure chamber, and said fifth valve port being selectively connected to said high pressure chamber via said pressure passage in response to actuation of said defrosting valve member;

a first connecting member for connecting said first pressure converting chamber to said second pressure converting chamber so as to equalize pressures in said first and second pressure converting chambers with each other;

a second connecting member for connecting said first and second pressure converting chambers to said second valve port for the inlet of the compressor; and, electromagnetic valve means interposed in said second connecting member for selectively opening and closing a passage of said second connecting member so as to communicate said first and second pressure converting chambers with said second valve port in cooperation with said second connecting member, whereby when said electromagnetic valve means opens the passage of said second connecting member to produce lower pressure than the pressure in said high pressure chamber at least in said second pressure converting chamber, said defrosting valve member is actuated to pass said high temperature and high pressure refrigerant in said high pressure chamber to said outdoor heat exchanger via said pressure passage and fifth valve port while said indoor heat exchanger receives the high temperature and high pressure refrigerant from said high pressure chamber to heat the ambient atmosphere thereof.

19. A five-way valve as claimed in claim 18, wherein said pressure passage is constructed of a first passage capable of flowing a first amount of said high temperature and high pressure refrigerant therethrough, and a second passage capable of flowing a second amount of said refrigerant less than said first amount.

20. A five-way valve as claimed in claim 19, wherein said defrosting valve means includes a second compression spring for urging said defrosting valve member toward said fifth valve port to close a passage between said fifth valve port and said first passage when both said high pressure chamber and said second pressure converting chamber are under substantially equal pressure by means of said second passage and first connecting member.

21. A five-way valve as claimed in claim 18, wherein said piston means includes a first compression spring for urging said piston means toward said high pressure chamber when both said high pressure chamber and said first pressure converting chamber are under substantially equal pressure by means of said pressure equalizer.

22. A five-way valve as claimed in claim 18, wherein said pressure equalizer is a through hole having a first diameter; and said passage of the second connecting member has a second diameter greater than the first diameter of said through hole, whereby an amount of the high temperature and high pressure refrigerant supplied from the high pressure chamber to the first pressure converting chamber via said through hole is smaller than that exhausted from the first pressure converting chamber to the second valve port via said passage of the second connecting member.

23. A five-way valve as claimed in claim 18, wherein said defrosting valve member has a first diameter and a second diameter greater than said first diameter along a longitudinal axis thereof; and said fifth valve port has a third diameter smaller than said first diameter as well as said second diameter.

24. A five-way valve as claimed in claim 23, wherein said first diameter of said defrosting valve member is selected to be approximately 0.9 cm, said second diameter thereof is selected to be approximately 1.67 cm, and said third diameter of said fifth valve port is selected to be approximately 0.6 cm.

25. A five-way valve operable in a refrigerant flow reversing system comprising:

a hollow valve body for defining a high pressure chamber therein, said high pressure chamber including a first valve port communicating with an outlet of a compressor to receive a high temperature and high pressure refrigerant, a second valve port communicating with an inlet of said compressor, a third valve port communicating with an outdoor heat exchanger, and a fourth valve body communicating with an indoor heat exchanger;

electronic reciprocating means connected to one end of said hollow valve body, and having a reciprocating member capable of being reciprocated between at least three rest positions;

slider valve means slidably provided within said high pressure chamber, for selectively communicating said second valve port for said inlet of the compressor with one of said third and fourth valve ports, whereby said indoor and outdoor heat exchangers are selectively changed to selectively heat and cool ambient atmosphere thereof;

defrosting valve means provided at the other end of said hollow valve body, and having a defrosting valve member, a pressure passage for sliding said defrosting valve member therethrough, and a fifth valve port communicating with said outdoor heat exchanger, said pressure passage communicating with said high pressure chamber and said fifth valve port by means of said defrosting valve member to receive the high temperature and high pressure refrigerant from the high pressure chamber; and a sliding member one end of which is connected to said reciprocating member and the other end of which selectively abuts against said defrosting valve member in response to the reciprocating operation of said reciprocating member, and having a concave loosely engaged with said sliding valve means with having a predetermined clearance between one edge portion of said sliding valve means and the corresponding edge of said concave, whereby when said reciprocating means slides said sliding valve means to communicate said inlet of the compressor with said outdoor heat exchanger and to actuate said defrosting valve means, the high temperature and high pressure refrigerant in said high pressure chamber is supplied by said defrosting valve means to said outdoor heat exchanger via the fifth valve port while said indoor heat exchanger receives the high temperature and high pressure refrigerant from said high pressure chamber to heat the ambient atmosphere thereof.

26. A five-way valve as claimed in claim 25, wherein said reciprocating means includes:

an electromagnetic coil;

a plunger magnetically coupled to said electromagnetic coil and connected to said sliding member;

a fixed core provided within said electromagnetic coil to receive said plunger;

first and second compression springs for urging said plunger to be stopped at said three rest positions in cooperation with the electromagnetic force exerted from said electromagnetic coil.

27. A five-way valve as claimed in claim 25, wherein said defrosting valve member includes:

a main defrosting valve; and a pilot valve; said pressure passage includes:

a first pressure passage for storing said main defrosting valve;

a second pressure passage for storing said pilot valve, and a third pressure passage for communicating said first pressure passage with said second pressure passage, whereby when the other end of said sliding member abuts against said pilot valve, said pilot valve firstly opens the second pressure passage and secondly said main valve opens the first pressure passage in cooperation with said third pressure passage so as to pass the high temperature and high pressure refrigerant in said high pressure chamber to said outdoor heat exchanger via mainly said main defrosting valve.

* * * * *